US011519672B2

(12) United States Patent
Lin et al.

(10) Patent No.: US 11,519,672 B2
(45) Date of Patent: Dec. 6, 2022

(54) LIQUID-COOLED HEAT DISSIPATION DEVICE AND VEHICLE

(71) Applicant: Gogoro Inc., Wanchai (HK)

(72) Inventors: Sung-Ching Lin, Taoyuan (TW); Tzu-Wen Liao, Taoyuan (TW); Yi-Hsiang Lin, Taoyuan (TW); Kai-Chiang Li, Taoyuan (TW); Yi-Chen Lu, Taoyuan (TW)

(73) Assignee: Gogoro Inc., Wanchai (HK)

( * ) Notice: Subject to any disclaimer, the term of this patent is extended or adjusted under 35 U.S.C. 154(b) by 204 days.

(21) Appl. No.: 16/901,320

(22) Filed: Jun. 15, 2020

(65) Prior Publication Data

US 2020/0393200 A1 Dec. 17, 2020

Related U.S. Application Data

(60) Provisional application No. 62/862,224, filed on Jun. 17, 2019.

(51) Int. Cl.
*F01P 5/00* (2006.01)
*F28D 7/16* (2006.01)
(Continued)

(52) U.S. Cl.
CPC ..... *F28D 7/1676* (2013.01); *F01P 5/04* (2013.01); *F01P 5/12* (2013.01); *F01P 11/04* (2013.01);
(Continued)

(58) Field of Classification Search
CPC .... F28D 1/024; F28D 2001/0273; F01P 5/02; F01P 5/04; F01P 5/10; F01P 5/12; F01P 2070/32
See application file for complete search history.

(56) References Cited

U.S. PATENT DOCUMENTS 5,078,206 A * 1/1992 Goetz, Jr. ..... F28F 1/02 165/44
5,172,752 A 12/1992 Goetz, Jr.
(Continued)

FOREIGN PATENT DOCUMENTS

CN 103245219 A 8/2013
DE 102016116276 A1 3/2018
(Continued)

OTHER PUBLICATIONS

European Search Report for Serial No. EP 20180514.0 dated Oct. 26, 2020.
(Continued)

*Primary Examiner* — Eric S Ruppert
(74) *Attorney, Agent, or Firm* — McCormick, Paulding & Huber PLLC

(57) ABSTRACT

A liquid-cooled heat dissipation device is disclosed, comprising a main body, a centrifugal pump, an inlet pipe, an outlet pipe, a centrifugal fan and a motor. The main body comprises a shaft hole, liquid flow channels and airflow channels. The centrifugal pump guides a cooling liquid through the inlet pipe, main body and outlet pipe. The centrifugal fan guides air into the main body axially from the shaft hole. After passing through the centrifugal fan, the air forms centrifugal airflows and leaves the body radially through the airflow channels. With an extended flow path of the cooling liquid and the radial flow of the centrifugal airflow provided by the present invention, the temperature of the cooling liquid may be quickly reduced and the cooling effect may be improved. Thus, the structure is compact, small, light-weight, easy-to-assemble.

19 Claims, 17 Drawing Sheets

(51) Int. Cl.

| | |
|---|---|
| ***F04D 13/06*** | (2006.01) |
| ***F04D 25/06*** | (2006.01) |
| ***F28D 15/00*** | (2006.01) |
| ***F01P 5/04*** | (2006.01) |
| ***F01P 5/12*** | (2006.01) |
| ***F01P 11/04*** | (2006.01) |
| ***F28D 1/02*** | (2006.01) |
| *F28D 21/00* | (2006.01) |
| *F01P 1/06* | (2006.01) |
| *F01P 3/12* | (2006.01) |

(52) U.S. Cl.

CPC ..... *F04D 13/06* (2013.01); *F04D 25/06* (2013.01); *F28D 1/024* (2013.01); *F28D 15/00* (2013.01); *F01P 1/06* (2013.01); *F01P 3/12* (2013.01); *F01P 2070/32* (2013.01); *F28D 2001/0273* (2013.01); *F28D 2021/008* (2013.01)

(56) References Cited

U.S. PATENT DOCUMENTS

| | | | | |
|---|---|---|---|---|
| 5,570,998 | A * | 11/1996 | Nomoto | F04D 29/242 416/186 R |
| 6,019,165 | A | 2/2000 | Batchelder | |
| 8,613,282 | B2 | 12/2013 | Nikolchev et al. | |
| 2006/0144568 | A1 | 7/2006 | Crocker et al. | |
| 2006/0193115 | A1 | 8/2006 | Chen et al. | |
| 2006/0237172 | A1 | 10/2006 | Lo | |
| 2007/0000268 | A1 | 1/2007 | Crocker et al. | |
| 2007/0000648 | A1 | 1/2007 | Crocker et al. | |
| 2009/0090489 | A1 | 4/2009 | Chiang | |
| 2011/0272120 | A1 | 11/2011 | Joshi et al. | |
| 2012/0199335 | A1 | 8/2012 | Maurer | |
| 2017/0070125 | A1 | 3/2017 | Bei et al. | |
| 2019/0210039 | A1 | 7/2019 | Kuhn | |
| 2020/0392891 | A1 | 12/2020 | Lin et al. | |

FOREIGN PATENT DOCUMENTS

| | | | | |
|---|---|---|---|---|
| FR | 2567256 | A * | 1/1986 | F01P 5/02 |
| TW | M277977 | U | 10/2005 | |
| TW | 200829152 | A | 7/2008 | |
| TW | M512123 | U | 11/2015 | |
| TW | I619918 | B | 4/2018 | |
| WO | 2018007735 | A1 | 1/2018 | |

OTHER PUBLICATIONS

European Search Report for Serial No. EP 20180513.2 dated Oct. 22, 2020.

Taiwanese Search Report and English Translation for Serial No. 109116777 dated Jan. 17, 2021.

Taiwanese Search Report and English Translation for Serial No. 109116782 dated Jan. 17, 2021.

* cited by examiner

LIQUID-COOLED HEAT DISSIPATION DEVICE AND VEHICLE

CROSS-REFERENCE TO RELATED APPLICATION

This application claims the priority of U.S. provisional application No. 62/862,224, filed on Jun. 17, 2019, which is incorporated herewith by reference.

BACKGROUND OF THE INVENTION

1. Field of the Invention

The present invention relates generally to a heat dissipation device and a vehicle, in particular, to a vehicle including the liquid-cooled heat dissipation device. The heat dissipation device is structurally designed to reduce the temperature of the coolant so as to circularly provide a low-temperature coolant to the object to dissipate heat, thereby reducing the temperature of the object to dissipate heat.

2. The Prior Arts

Referring to FIG. 1, FIG. 1 is a schematic view of a conventional heat dissipation system. The conventional heat dissipation system generally includes a tank 201, a pump 202, and a radiator 203. The tank 201 contains coolant. The pump 202 draws the coolant from the tank 201 and sends the coolant to a motor 206 through a pipeline 2041. After passing through the motor 206, the coolant is sent to the radiator 203 through a pipeline 2042. After passing through the radiator 203, the coolant is sent to a heat source that needs to be cooled through a pipeline 2043, such as a motor controller 205. After passing through the motor controller 205, the coolant returns to the tank 201 through a pipeline 2044 for repeated use. The coolant can absorb the heat generated by the motor controller 205 and the motor 206 during operation, thereby cooling the temperature of the motor controller 205 and the motor 206. As a result, overheating of these components can be avoided.

However, each component of the conventional heat dissipation system is large and occupies a lot of space.

Furthermore, each component of the conventional heat dissipation system is locked in at a different position of the vehicle. Multiple pipelines 2041-2044 are required to allow the coolant to flow among these components, which is complicated in assembly.

In addition, in order to save space, the radiator 203 of the conventional heat dissipation system cannot smoothly guide the coolant into the heat dissipation fin tube (not shown). Therefore, the coolant will impact the wall at the corner of the radiator 203, thus causing turbulence. Besides the loss in fluid motion, the flow of the coolant is unevenly distributed.

Moreover, due to the small cross-sectional area of the pipeline 2044, when the coolant enters the tank 201 through the pipeline 2044, the flow of the coolant is considerably fast under the same volume flow rate; hence, agitation may easily happen and many bubbles may be generated. The cooling effect of the coolant will be reduced when the coolant contains a large number of bubbles.

FIG. 2 is a schematic view of another conventional heat dissipation system. Referring to FIG. 2, this conventional heat dissipation system comprises a radiator 301 and an axial fan 302 installed on the axial surface of the radiator 301. The air inlet side of this conventional heat dissipation system is located on the axial surface of the radiator 301, and the air outlet side is located on the axial surface of the axial fan 302. As such, during installation, the radiator 301 is directly installed on the heat source, so that the heat may be dissipated to the air outlet side by the axial fan 302 to achieve the heat dissipation.

However, for this conventional heat dissipation system to achieve the expected heat dissipation effect, sufficient space must be retained at the air outlet side thereof. Such a limitation ends up requiring a large installation space for the heat dissipation system, which in turn, increases the volume required for the overall system.

Moreover, the air outlet area of the axial fan 302 is mainly located in the ring-shaped section containing the fan blades, so there is no airflow outside the fan blade section or in the area blocked by the fan central motor and the four-corner chassis. In other words, this conventional heat dissipation system is unable to effectively utilize all the space for heat dissipation, thus resulting in poor heat dissipation efficiency.

SUMMARY OF THE INVENTION

The primary objective of the present invention is to provide a liquid-cooled heat dissipation device with an extended flow path for the coolant. The extended flow path in combination with the radial flow of centrifugal airflow, allows the temperature of the coolant to reduce quickly, thus improving the cooling effect of the coolant.

Another objective of the present invention is to provide a liquid-cooled heat dissipation device, which is equivalent to the integration of the traditional heat dissipation system which at least includes a tank, a pump and a radiator. Such an integrated structure eliminates the need of the pipelines. As such, the overall liquid-cooled heat dissipation device of the present invention has the advantage of a compact structure, small size, light weight and good structural strength. In addition, the device of the present invention can be easily mounted on or near any object to be thermally dissipated.

Yet another objective of the present invention is to provide a liquid-cooled heat dissipation device that allows the centrifugal airflow generated thereby to pass straight through the airflow channels, so that the flow resistance of the airflow is reduced. In such a way, a higher airflow velocity may be obtained, and the heat dissipation efficiency of the system under the same fan power may be improved.

Still another objective of the present invention is to provide a vehicle equipped with the liquid-cooled heat dissipation device of the present invention. The liquid-cooled heat dissipation device of the present invention can provide a good heat dissipation effect for the object to be dissipated of the vehicle.

To achieve the foregoing objectives, the present invention provides a liquid-cooled heat dissipation device, comprising a main body, a centrifugal pump, an inlet pipe, an outlet pipe, a centrifugal fan and a motor.

The main body comprises: a shaft hole, a plurality of liquid flow channels and a plurality of airflow channels, the liquid flow channels being arranged around the shaft hole along a circumferential direction, and each of the airflow channels being located between the liquid flow channels and connected to outside space; the centrifugal pump being disposed in the main body; the inlet pipe being in communication with the main body; the outlet pipe being in communication with the main body; the centrifugal fan being disposed in the shaft hole; and the motor being disposed in the centrifugal fan and configured to drive the centrifugal pump and the centrifugal fan to rotate simultaneously through a drive shaft; wherein when the drive shaft is rotating, the rotation of the centrifugal pump guides a cooling liquid to pass through the inlet pipe, the main body and the outlet pipe in sequence; and wherein when the drive shaft is rotating, the rotation of the centrifugal fan guides air to axially flow through the shaft hole into the main body; once the air passes through the centrifugal fan, the air forms centrifugal airflows and leaves the main body radially through the airflow channels.

Preferably, outflow direction of each of the centrifugal airflows exiting the centrifugal fan is aligned with a length direction of each of the airflow channels.

Preferably, assuming a speed vector of the centrifugal airflow in a tangential direction to the circumference of the centrifugal fan is U, a speed vector of the centrifugal airflow under Global coordinate system is V, an angle between V and U is $\alpha$, and the length direction of each of the airflow channels is L, a tangential direction to the circumference of the liquid-cooled heat dissipation device is $\theta$ and an angle between L and $\theta$ is $\alpha'$, then $\alpha=\alpha'$.

Preferably, assuming the velocity vector of the centrifugal airflow with respect to the tip of a fan blade of the centrifugal fan is W, then a combined velocity vector of W and U is V.

Preferably, the liquid flow channels are arranged at intervals, and each of the airflow channels is formed between two adjacent liquid flow channels.

Preferably, a cross-sectional shape of each of the liquid flow channels is fan-shaped, and a cross-sectional shape of each of the airflow channels is rectangular.

Preferably, each of the liquid flow channels has a tip, two planar side walls and a curved outer wall, the tip of each of the liquid flow channels faces a center of the main body, and the curved outer wall of each of the liquid flow channels is located on a side opposite to the tip, and the two planar side walls of every adjacent two liquid flow channels are parallel to each other.

Preferably, cross-sectional areas of each of the liquid flow channels are equal and cross-sectional areas of each of the airflow channels are equal.

Preferably, the main body further comprises a first cover and a second cover; the first cover is disposed on a first side of the liquid flow channels in an axial direction thereof; the first cover comprises a plurality of first hollow portions and a plurality of first sealed portions, the first hollow portions are respectively in communication with the liquid flow channels, and the first sealed portions respectively seal the first side of the airflow channels in an axial direction thereof; the second cover is disposed on a second side of the liquid flow channels in the axial direction thereof, the second cover comprises a plurality of second hollow portions and a plurality of second sealed portions, the second hollow portions are respectively in communication with the liquid flow channels, and the second sealed portions respectively seal the second side of the airflow channel in the axial direction.

Preferably, the shaft hole penetrates the first cover and the second cover, and both of the first cover and the second cover are circular.

Preferably, a cross-sectional shape of each of the first hollow portions respectively corresponds to a cross-sectional shape of each of the liquid flow channels, and a cross-sectional shape of each of the first sealed portions respectively corresponds to a cross-sectional shape of each of the airflow channels, a cross-sectional shape of each of the second hollow portions respectively corresponds to a cross-sectional shape of each of the liquid flow channels, and a cross-sectional shape of each of the second sealed portions respectively corresponds to a cross-sectional shapes of each of the airflow channels.

Preferably, the main body further comprises a first shell and a second shell, the first shell is located on a first side of the main body and seals the shaft hole, the second shell is located on the second side of the main body, the shaft hole penetrates through the second shell.

Preferably, the shaft hole penetrates through the second side of the main body.

Preferably, the main body further comprises a plurality of heat dissipation fins, and the heat dissipation fins are respectively disposed in the airflow channels.

Preferably, the drive shaft has a first end and a second end, the first end of the drive shaft is connected to and configured to drive the centrifugal pump to rotate, and the second end of the drive shaft is connected to and configured to drive the centrifugal fan to rotate.

Preferably, the centrifugal pump comprises a pump body and a plurality of pump blades, the drive shaft is connected to an axle of the pump body, the pump blades are arranged on the pump body around the axis of the pump body at intervals.

Preferably, the centrifugal fan comprises a fan body and a plurality of fan blades, the motor is located in the fan body, the drive shaft is connected to an axle of the fan body, the fan blades are disposed around the fan body at intervals and form an air-collecting chamber between the fan body.

Preferably, an air outlet chamber is formed between the centrifugal fan and the liquid flow channels.

Preferably, the main body further comprises a plurality of liquid storage tanks, the liquid storage tanks are respectively located on a first side and a second side of the main body, and two liquid storage tanks on different sides of the main body are in communication with each other through at least one of the liquid flow channels, the centrifugal pump is disposed in one of the liquid storage tanks, and the inlet pipe and the outlet pipe are respectively connected to two of the liquid storage tanks.

To achieve the foregoing objectives, the present invention provides a vehicle comprising the aforementioned liquid-cooled heat dissipation device, an external flow channel and at least one object to be thermally dissipated, the external flow channel passes through the at least one object to be thermally dissipated and is connected to the inlet pipe and the outlet pipe.

The present invention is advantageous in that the liquid-cooled heat dissipation device of the present invention can provide an extended flow path for the coolant. The extended flow path in combination with the radial flow of centrifugal airflow, allows the temperature of the coolant to reduce quickly, thus improving the cooling effect of the coolant.

Furthermore, the liquid-cooled heat dissipation device of the present invention is equivalent to the integration of the traditional heat dissipation system which at least includes a tank, a pump and a radiator. Such an integrated structure eliminates the need of the pipelines, As such, the overall liquid-cooled heat dissipation device of the present invention has the advantage of a compact structure, small size, light weight and good structural strength. In addition, the device of the present invention can be easily mounted on or near any object to be thermally dissipated.

In addition, the liquid-cooled heat dissipation device of the present invention allows the centrifugal airflow generated thereby to pass straight through the airflow channels, so that the flow resistance of the airflow is reduced. In such a way, a higher airflow velocity may be obtained, and the heat dissipation efficiency of the system under the same fan power may be improved.

Furthermore, the liquid-cooled heat dissipation device of the present invention can provide a good heat dissipation effect for the object to be dissipated of the vehicle.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
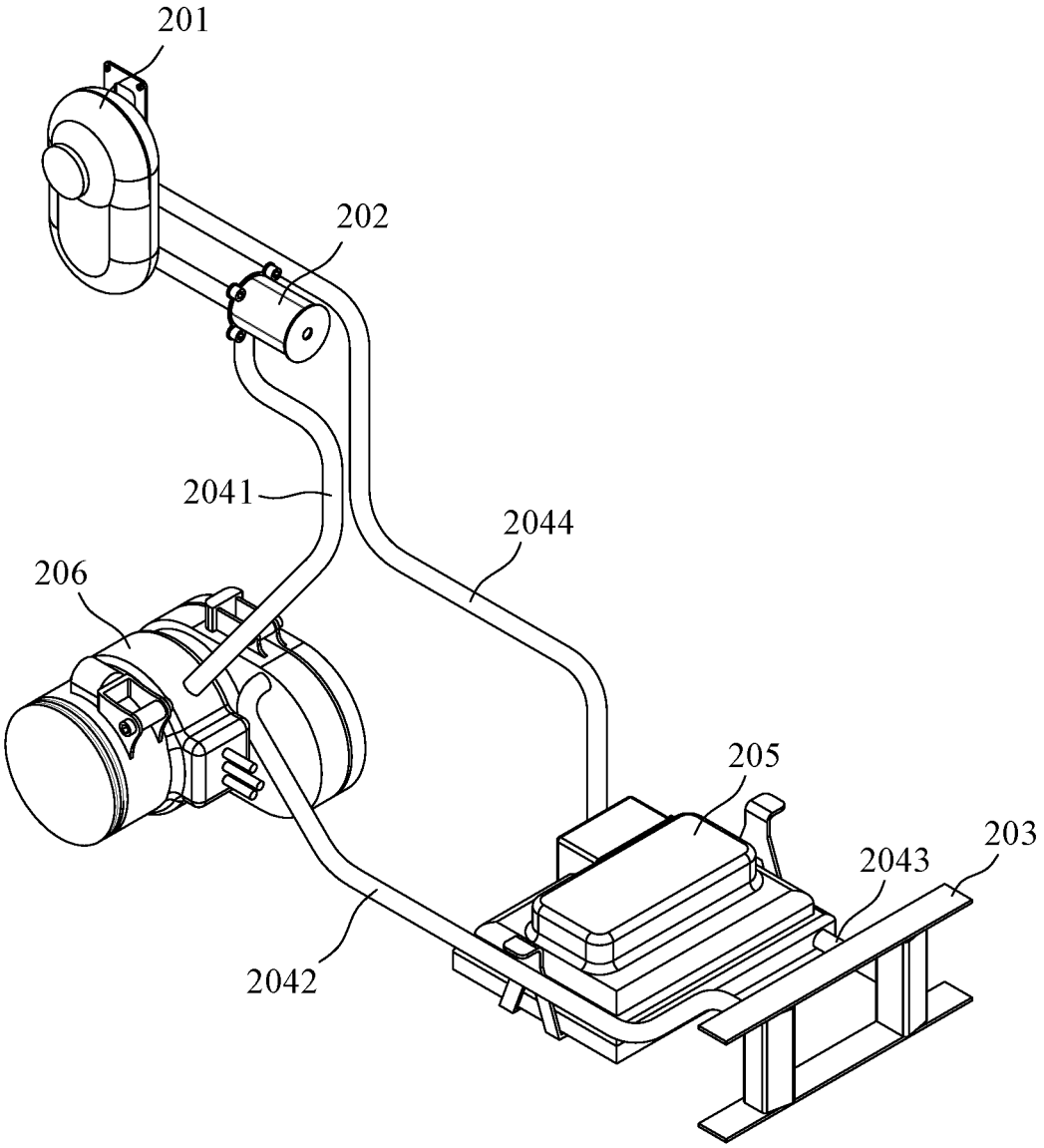
FIG. 1 (PRIOR ART)
FIG. 1 is a schematic view of a conventional heat dissipation system.
Figure 2:
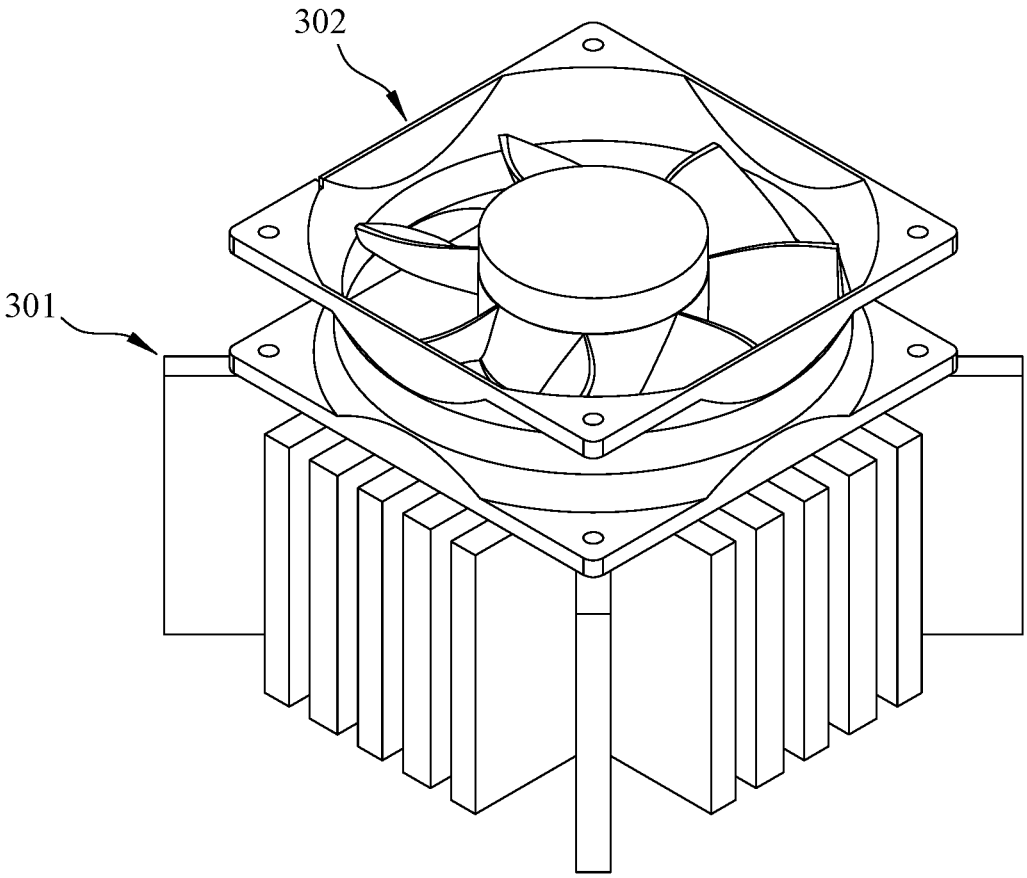
FIG. 2 (PRIOR ART)
FIG. 2 is a schematic view of another conventional heat dissipation system.
Figure 3:
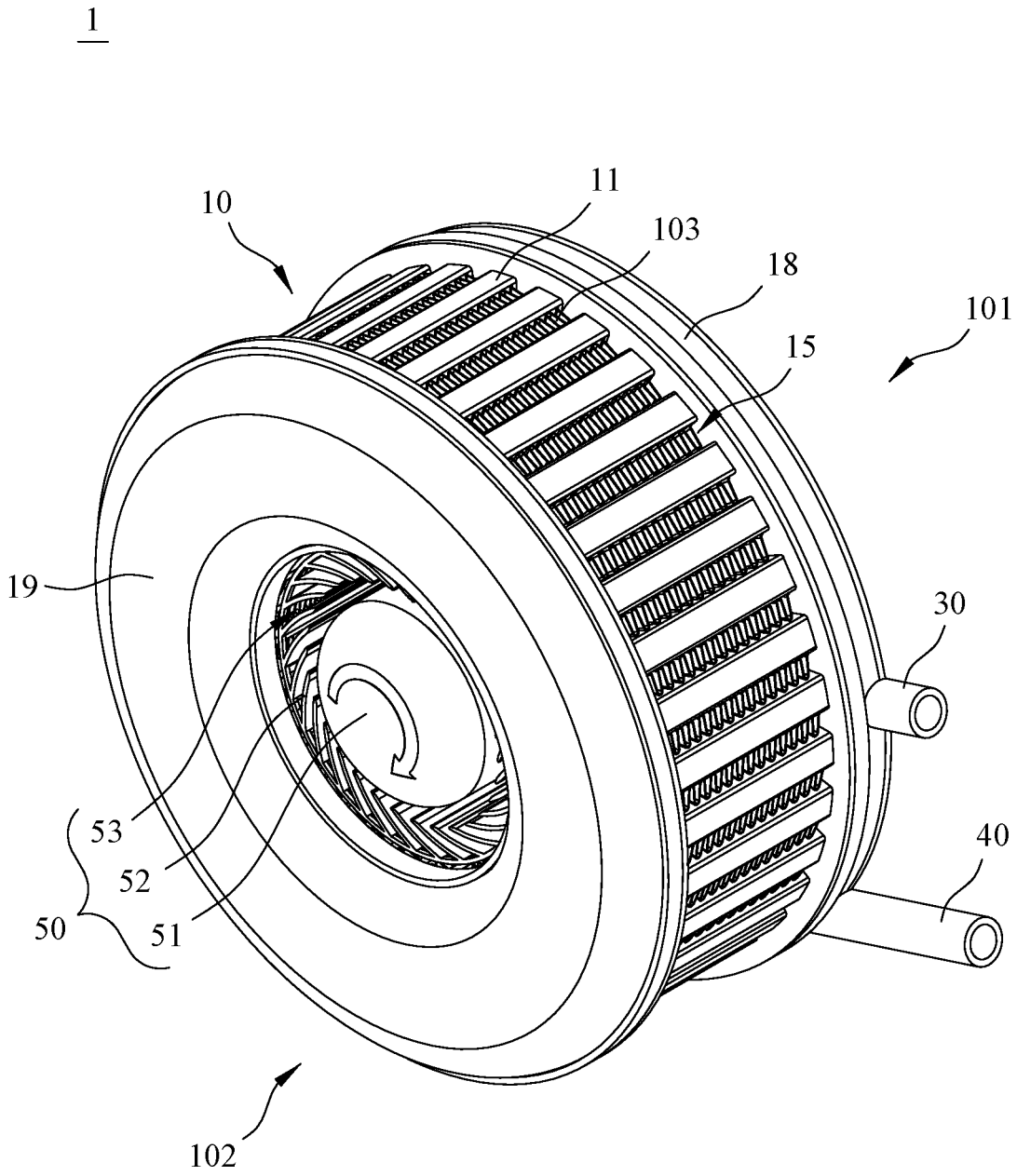
FIG. 3 is a perspective view of the liquid-cooled heat dissipation device of the present invention.
Figure 4:
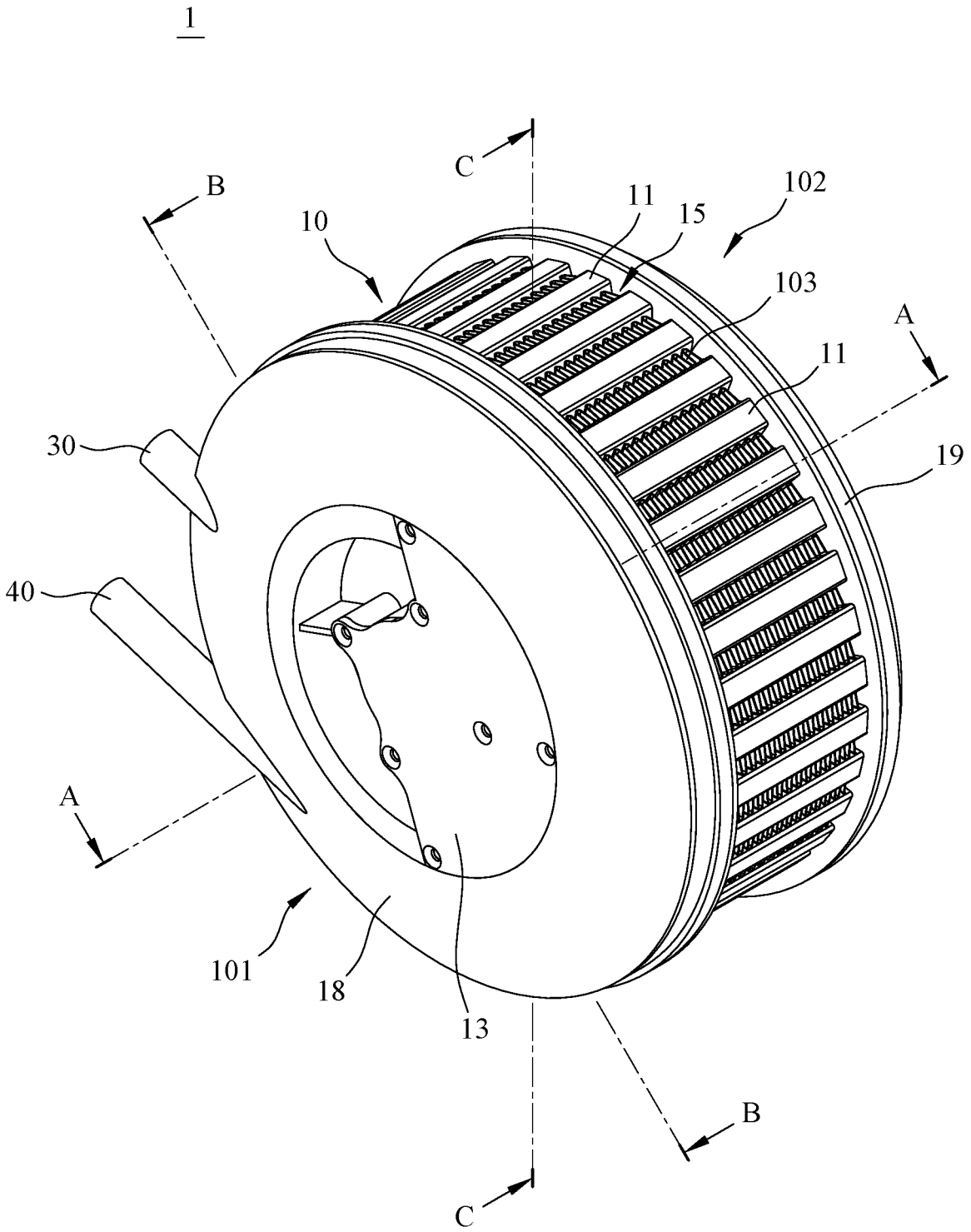
FIG. 4 is another perspective view of the liquid-cooled heat dissipation device of the present invention.
Figure 5:
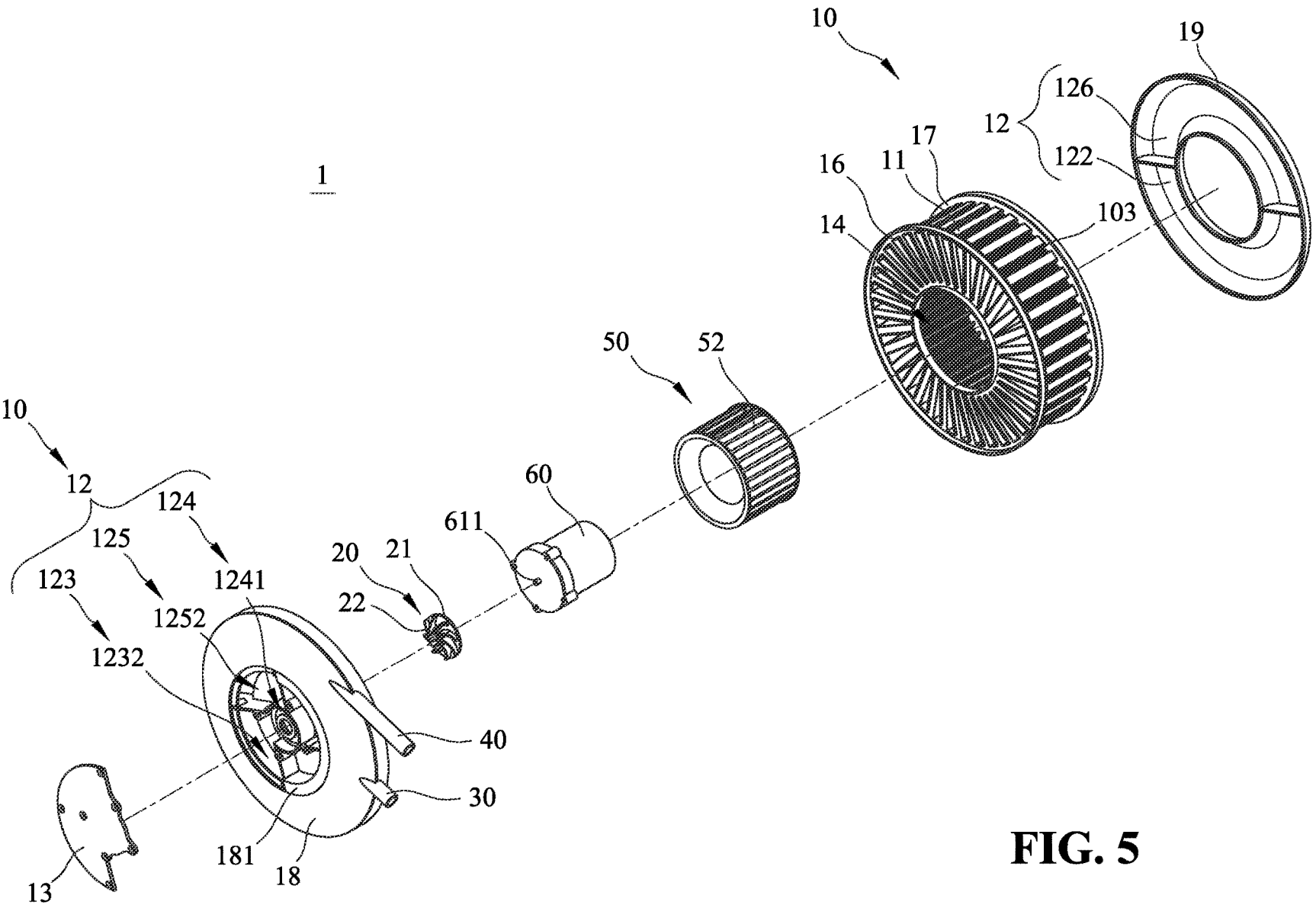
FIG. 5 is an exploded view of the liquid-cooled heat dissipation device of the present invention.

As shown in FIG. 3, FIG. 4 and FIG. 5, the present invention provides a liquid-cooled heat dissipation device 1, comprising a main body 10, a centrifugal pump 20, an inlet pipe 30 and an outlet pipe 40.

Figure 12:
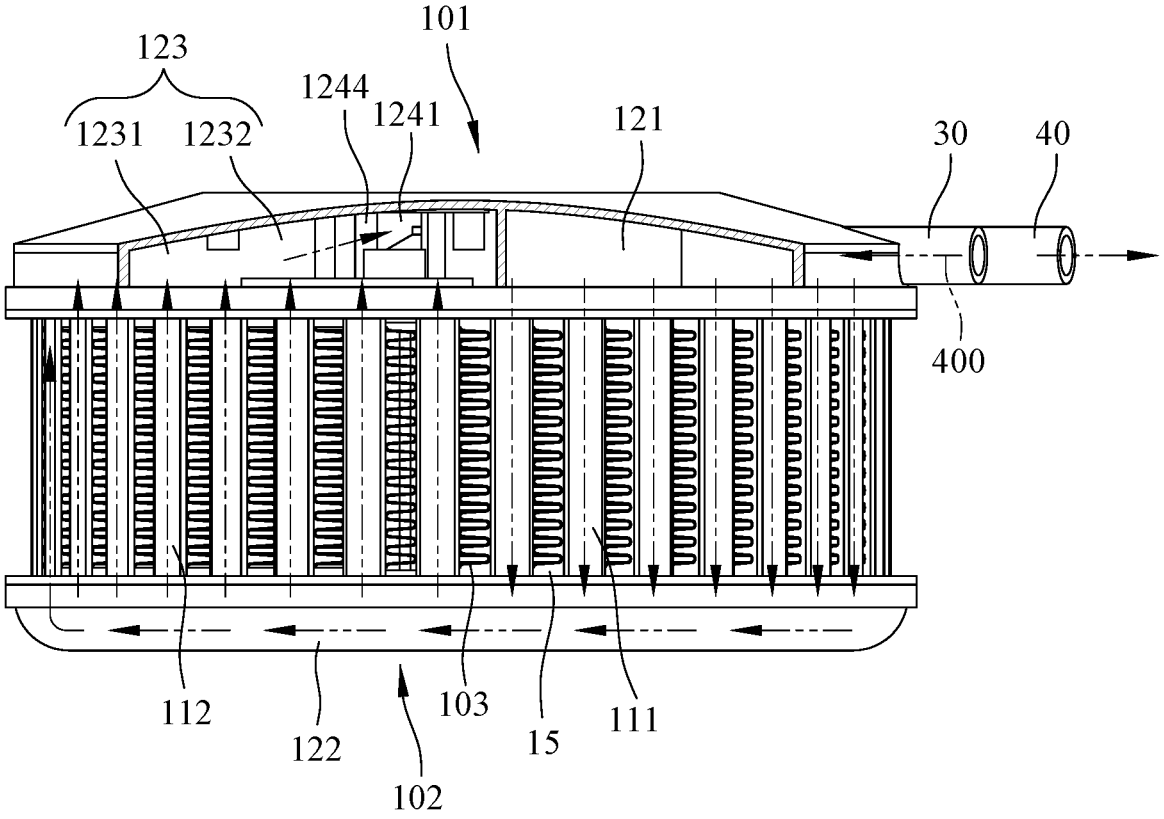
FIG. 12 is a schematic view illustrating the flow of the cooling liquid from the inlet pipe all the way to the outer tank of the centrifugal tank of the present invention.
Figure 15:
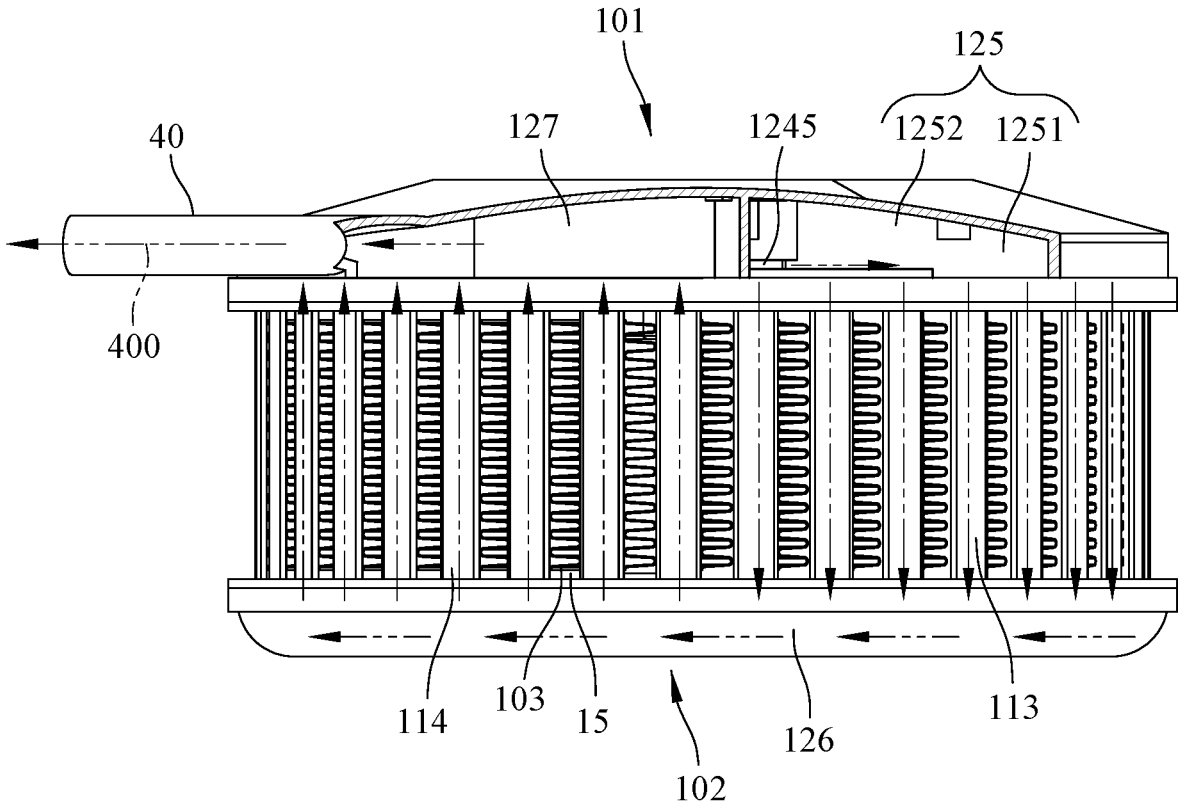
FIG. 15 is a schematic view illustrating the flow of the cooling liquid from the centrifugal tank all the way to the outlet pipe of the present invention.

As shown in FIG. 3 to FIG. 10, the main body 10 comprises liquid flow channels 11 and liquid storage tanks 12. As shown in FIG. 3 to FIG. 5 and FIG. 10, the liquid flow channels 11 are disposed along a circumferential direction at interval. As shown in FIG. 12 and FIG. 15, the liquid storage tanks 12 are respectively located on a first side 101 and a second side 102 of the main body 10, and the two liquid storage tanks 12 located on different sides of the main body 10 are interconnected through at least one of the liquid flow channels 11.

As shown in FIG. 5, the centrifugal pump 20 is disposed in one of the liquid storage tanks 12.

Figure 6:
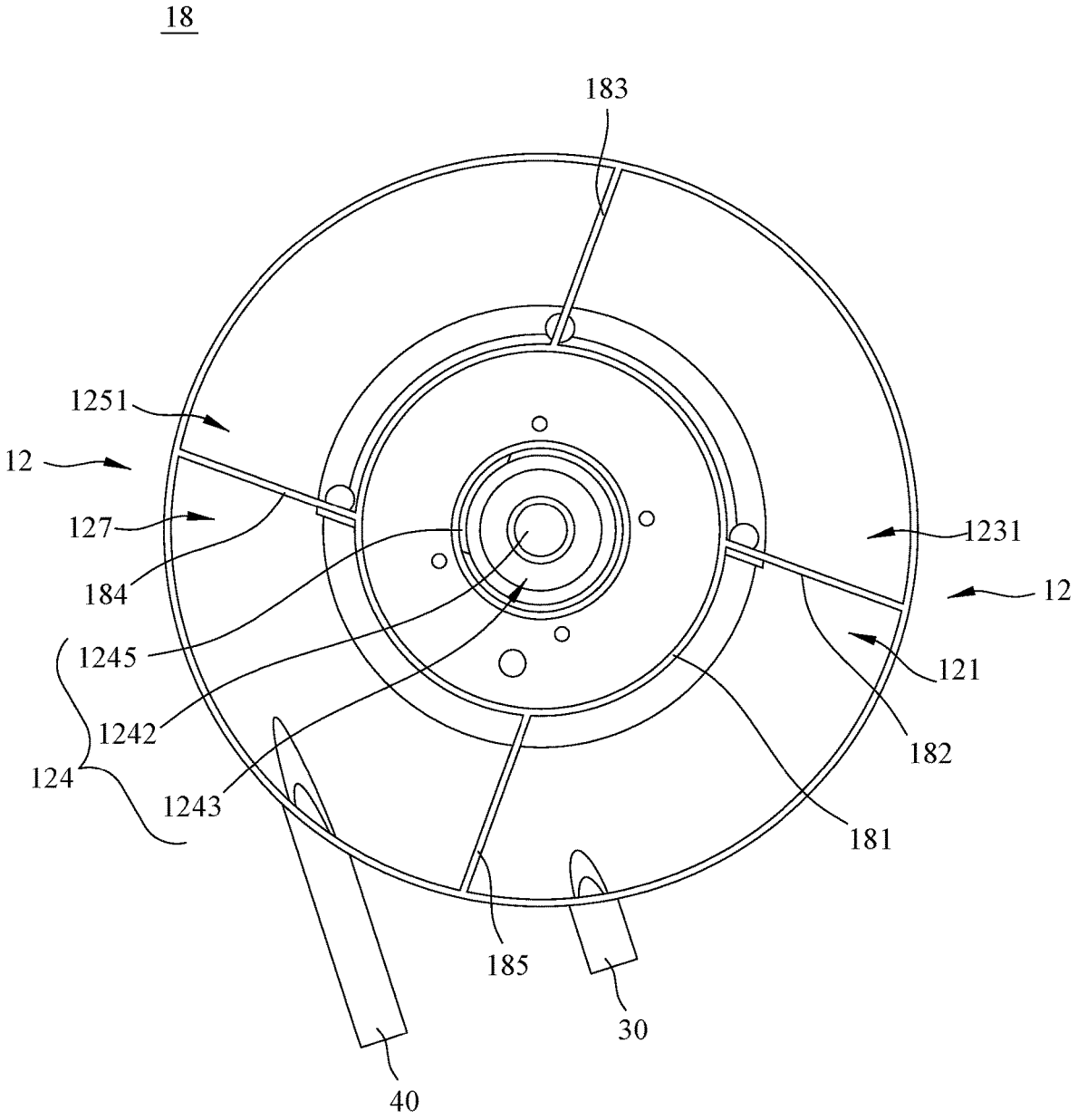
FIG. 6 is a bottom view of the first shell of the present invention.
Figure 7:
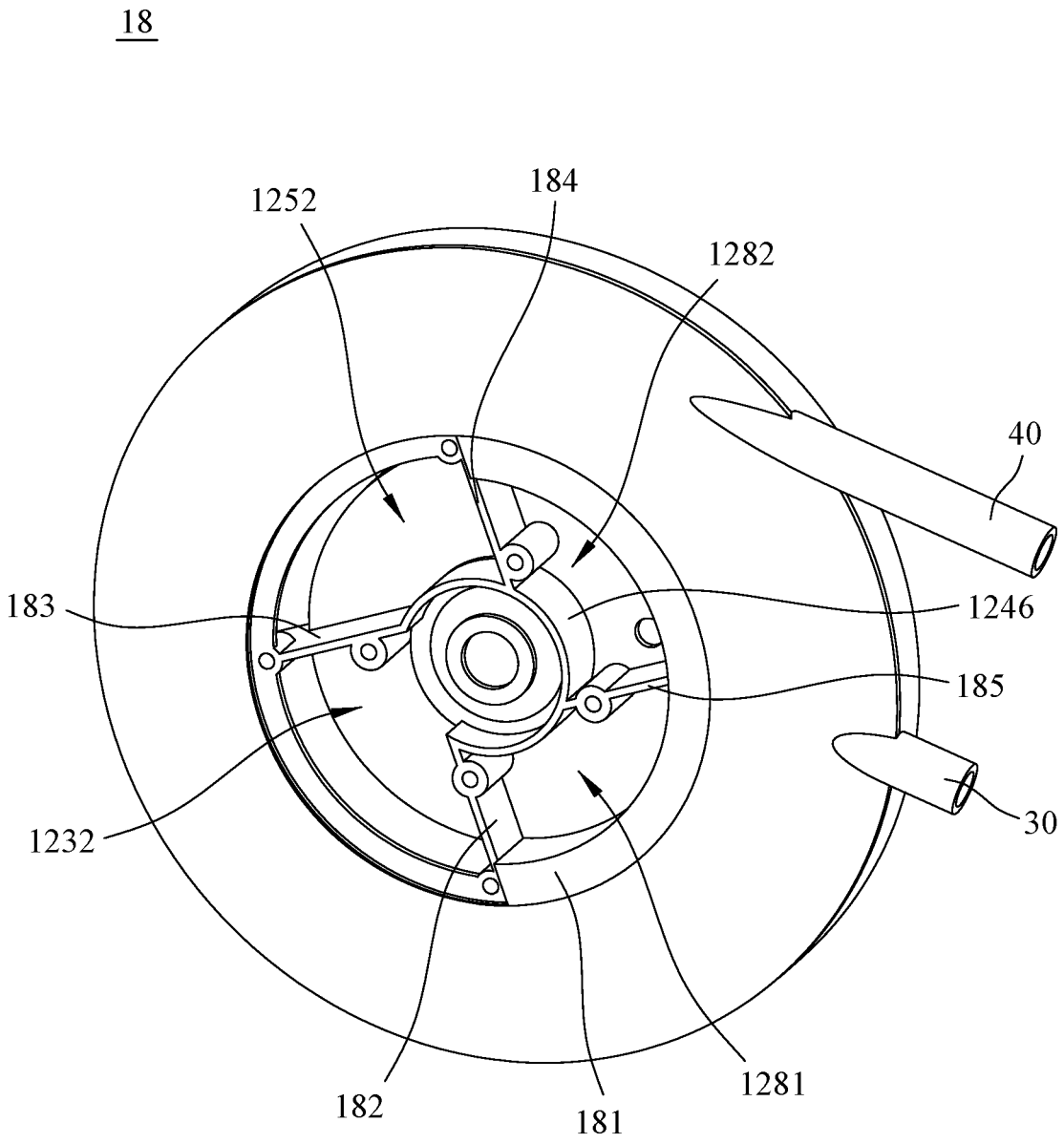
FIG. 7 is a perspective view of the first shell of the present invention.
Figure 8:
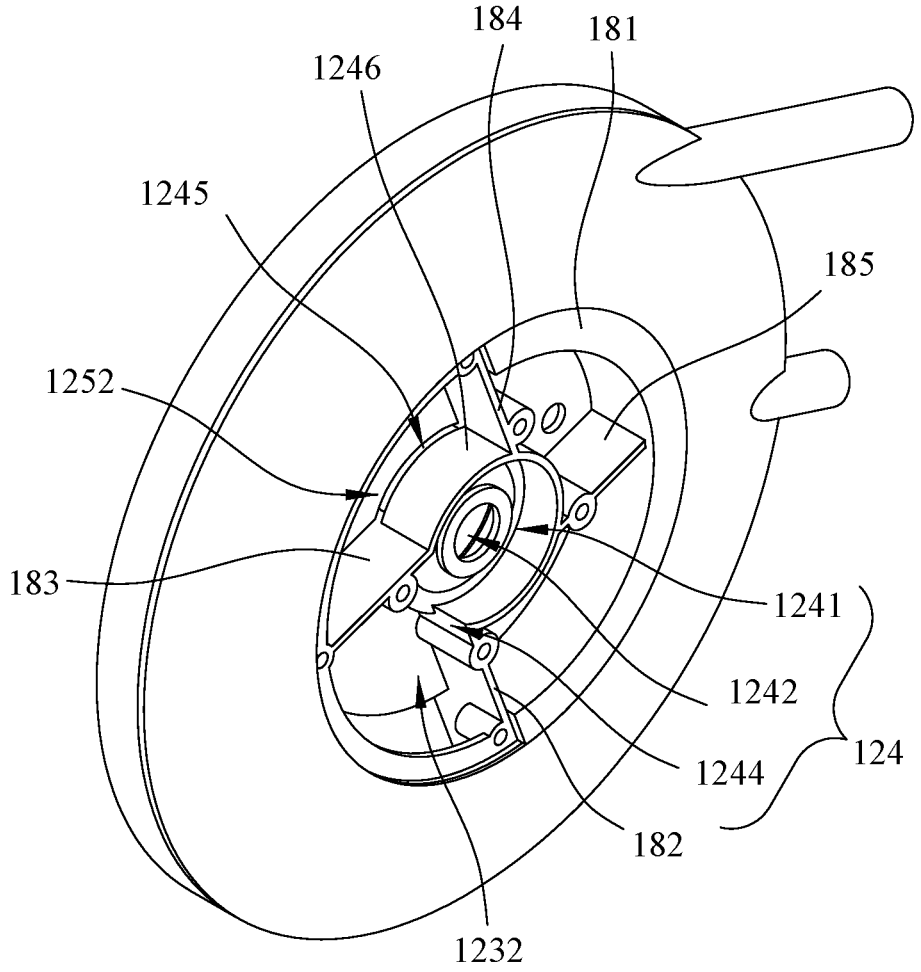
FIG. 8 is a perspective view of the second shell of the present invention.
Figure 9:
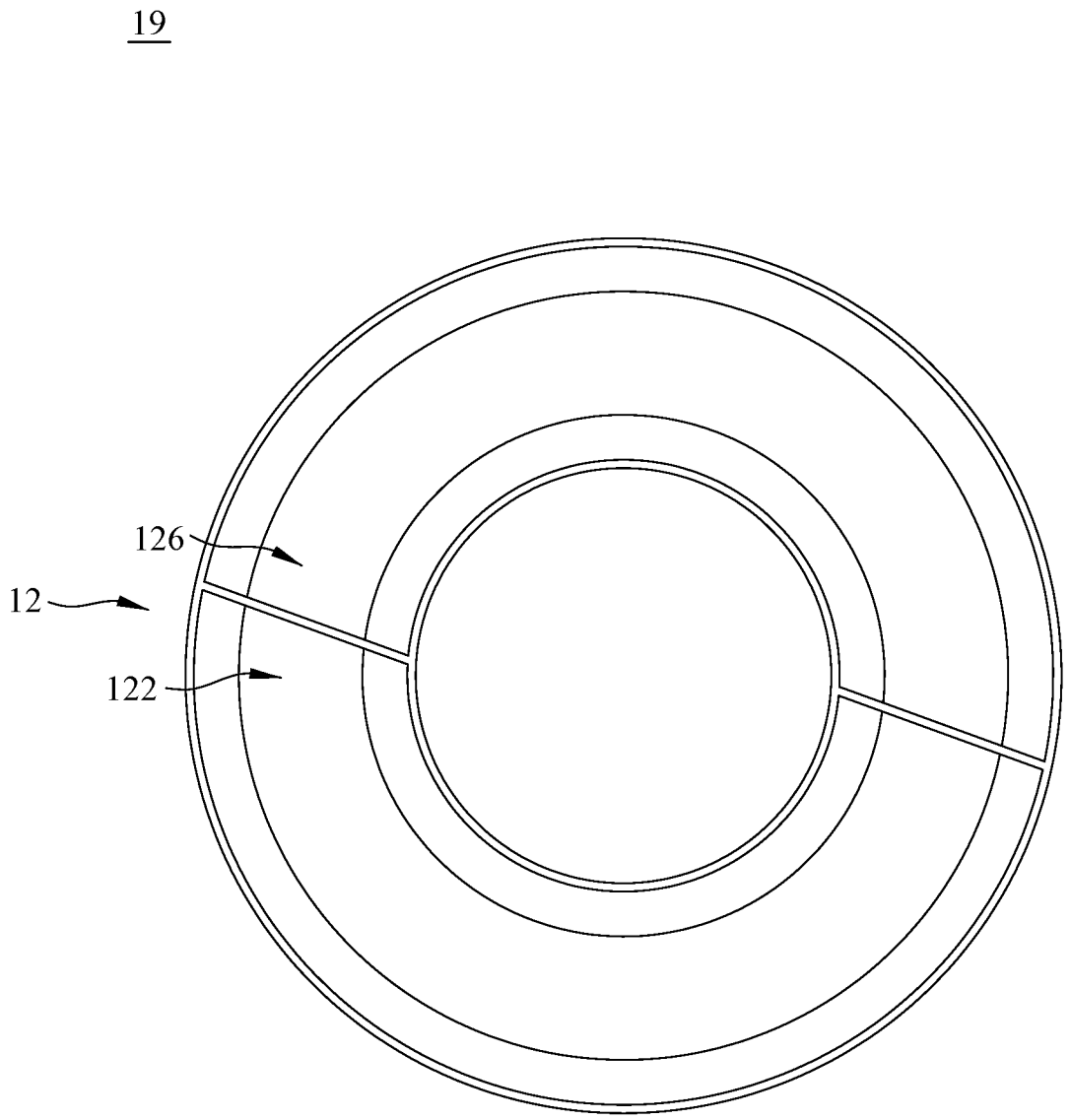
FIG. 9 is a top view of the second shell of the present invention.

As shown in FIG. 6, the inlet pipe 30 and the outlet pipe 40 are respectively in communication with two of the liquid storage tanks 12.

As shown in FIG. 11 to FIG. 15, the rotation of the centrifugal pump 20 guides a cooling fluid 400 to sequentially pass through the inlet pipe 30, the main body 10 and the outlet pipe 40. The cooling fluid 400 circulates among the liquid storage tanks 12 through the liquid flow channels 11 and forms multiple radial jet flows once it passes through the centrifugal pump 20.

Figure 11:
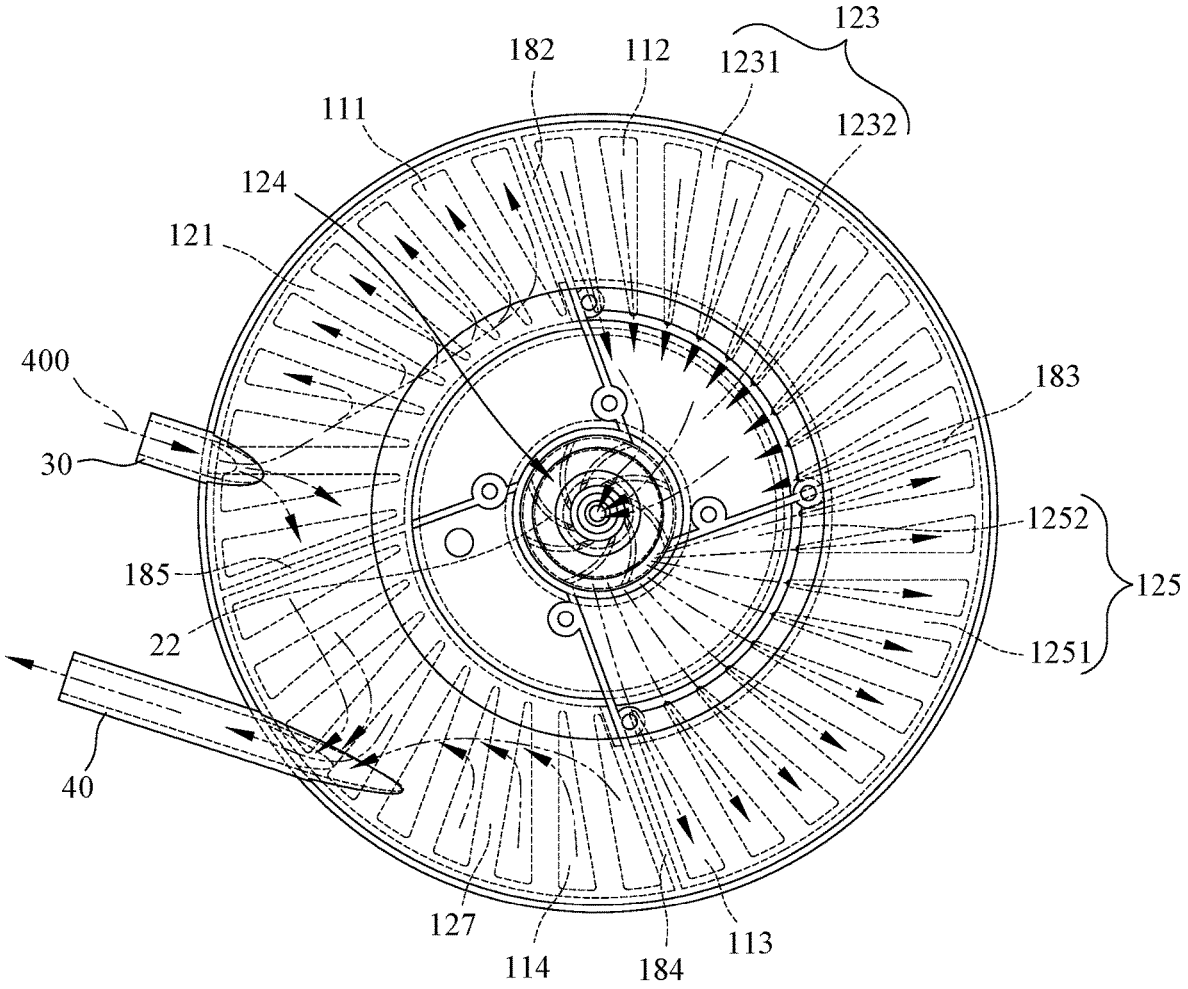
FIG. 11 is a schematic view illustrating the flow of the cooling liquid in the first shell of the present invention.
Figure 17:
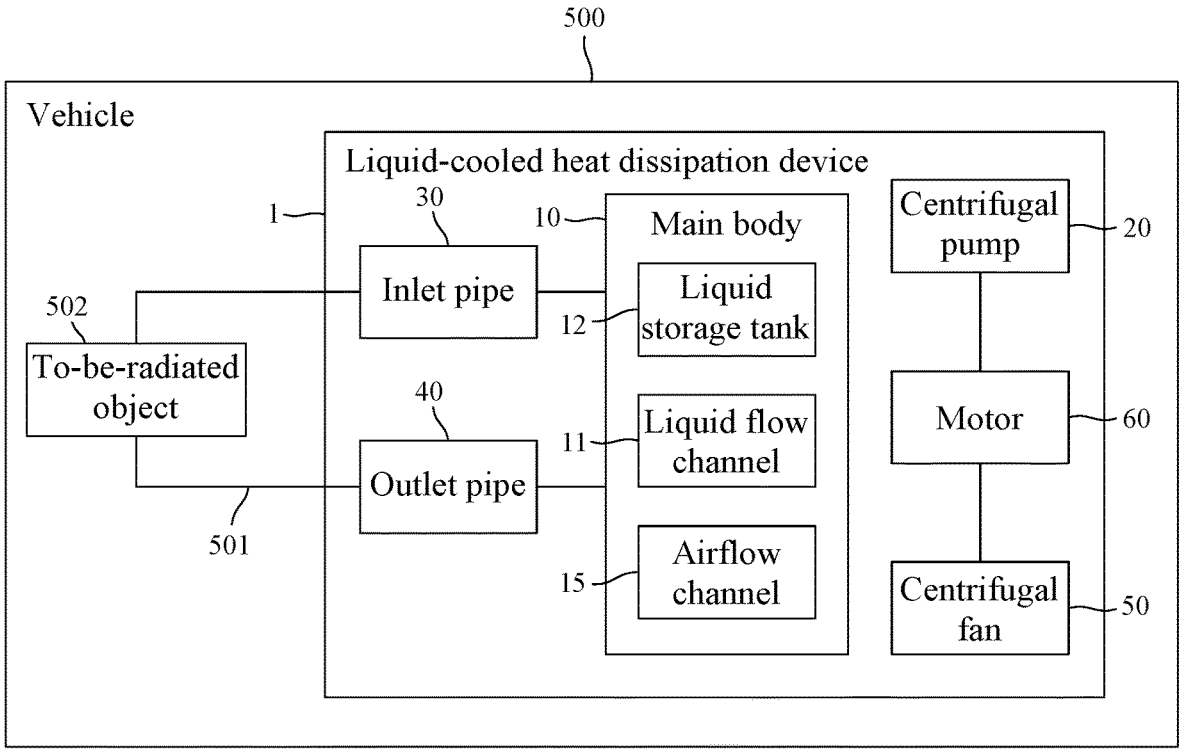
FIG. 17 is a schematic diagram of the vehicle of the present invention.

Furthermore, as shown in FIG. 17, an external flow channel 501 is configured to pass through an object 502 (i.e., the object that needs to be thermally dissipated) and is connected to the inlet pipe 30 and the outlet pipe 40. The low-temperature cooling liquid 400 absorbs the heat, which is generated during the operation of the object 502, during the passage of the external flow channel 501 and becomes a high-temperature cooling liquid 400. As shown in FIG. 11 and FIG. 12, the high-temperature cooling liquid 400 enters the main body 10 through the inlet pipe 30 along the external flow channel 501. As shown in FIG. 11 to FIG. 15, the rotation of the centrifugal pump 20 can guide the cooling liquid 400 to flow in the liquid flow channels 11 and to travel back and forth between the liquid storage tanks 12, so as to provide an extended flow path of the cooling liquid 400. As such, the heat dissipation area of the cooling liquid 400 is increased; consequently, the heat dissipation effect of the cooling liquid 400 is improved. As shown in FIG. 17, the cooled cooling liquid 400 will return to the external flow channel 501 through the outlet pipe 40 and be transported back to the object 502 through the external flow channel 501, thereby achieving the heat dissipation repeatedly. The object 502 may be a device such as an engine, a motor or a microprocessor of a vehicle 500, but it is not limited thereto. Any device requiring heat dissipation may be the object 502.

Since the liquid flow channels 11 and the liquid storage tanks 12 are arranged radially in accordance with the liquid flow direction generated by the centrifugal pump 20, the flow of the cooling liquid 400 flowing into the liquid storage tanks 12 from the inside of the centrifugal pump 20 is more stable and more evenly distributed, thus reducing the fluid motion loss.

It is worth noting that the total cross-sectional area of the liquid flow channels 11 is much larger than the cross-sectional area of the pipeline 2044 connected to the tank 201 in the conventional heat dissipation system. Therefore, under the same volume flow rate, the flow rate of the cooling liquid 400 in the liquid flow channels 11 entering the liquid storage tanks 12 is reduced. As a result, the turbulence within the cooling liquids 400 may be reduced, the amount of bubbles generated is decreased, and the heat absorbing efficiency of the cooling liquid 400 to the object 502 is increased.

Figure 13:
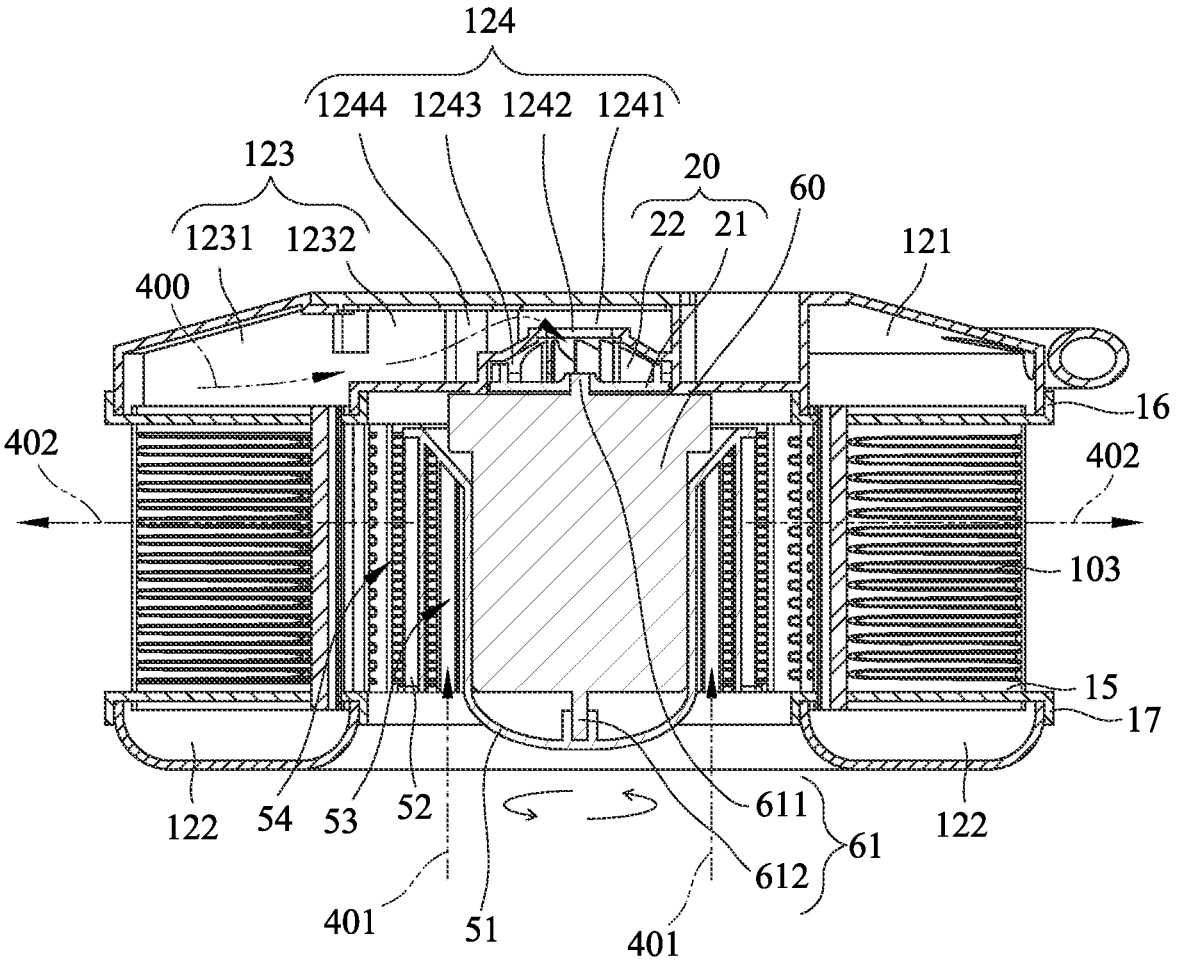
FIG. 13 is a cross-sectional view along line A-A of FIG. 4.
Figure 14:
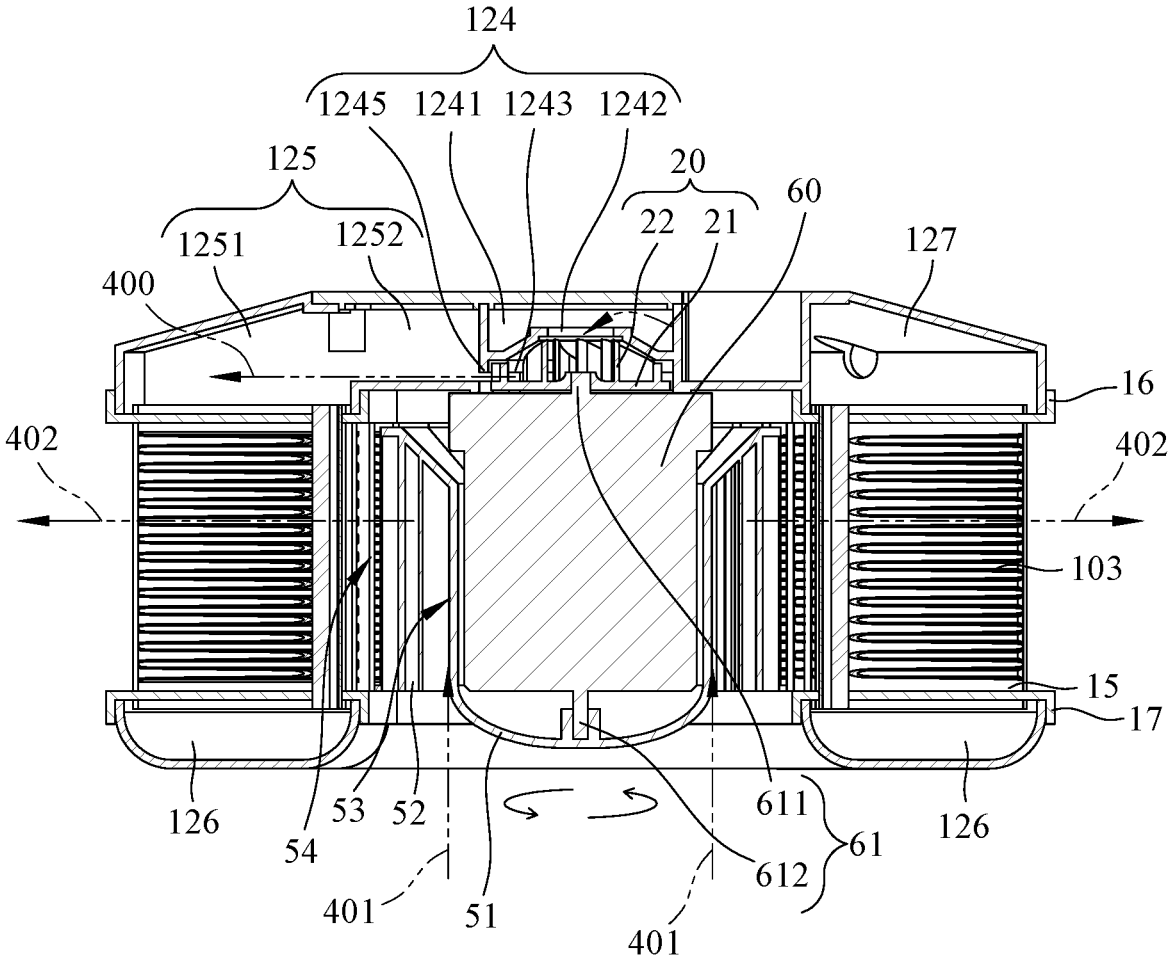
FIG. 14 is a cross-sectional view along line B-B of FIG. 4.

Furthermore, as shown in FIG. 5 to FIG. 10, the liquid storage tanks 12 comprise an input tank 121, at least one intermediate tank and an output tank 127. The liquid flow channels 11 comprise at least one input channel 111 and at least one output channel 114. The at least one input channel 111 is in communication with the input tank 121 and at least one intermediate tank. The at least one output channel 114 is in communication with at least one intermediate tank and the output tank 127. The centrifugal pump 20 is disposed in at least one intermediate tank. The inlet pipe 30 is in communication with the input tank 121, and the outlet pipe 40 is in communication with the output tank 127. As shown in FIG. 11 to FIG. 13, the rotation of the centrifugal pump 20 can guide the cooling liquid 400 to sequentially pass through the inlet pipe 30, the input tank 121, at least one input channel 111, and then to enter into at least one intermediate tank. As shown in FIG. 11, FIG. 14 and FIG. 15, the cooling liquid 400 in the at least one intermediate tank forms multiple radial jet flows after passing through the centrifugal pump 20. The rotation of the centrifugal pump 20 can further push the cooling liquid 400 to return to the external flow channel 501 through at least one intermediate tank, at least one output channel 114, output tank 127 and outlet pipe 40.

As such, through the input tank 121, at least one input channel 111, at least one intermediate tank, at least one output channel 114 and output tank 127, a considerably long flow path of the cooling liquid 400 is provided by the liquid-cooled heat dissipation device 1 of the present invention, thereby increasing the heat dissipation area of the cooling liquid 400 and improving the heat dissipation effect of the cooling liquid 400.

In a preferred embodiment, as shown in FIGS. 5-9 and FIG. 11, the liquid storage tanks 12 comprise five intermediate tanks, which are defined as a first top tank 123, a centrifugal tank 124, a second top tank 125, a first bottom tank 122 and a second bottom tank 126. As shown in FIG. 11 to FIG. 15, the centrifugal tank 124 is in communication with the first top tank 123 and the second top tank 125, at least one input channel 111 is in communication with the input tank 121 and the first bottom tank 122, and at least one output channel 114 is in communication with the second bottom tank 126 and the output tank 127. As shown in FIGS. 10-12, and FIG. 15, the liquid flow channels 11 further comprise at least one first intermediate channel 112 and at least one second intermediate channel 113. The at least one first intermediate channel 112 is in communication with the first bottom tank 122 and the first top tank 123, and at least one second intermediate channel 113 is in communication with the second top tank 125 and the second bottom tank 126. As shown in FIG. 11 to FIG. 13, the rotation of the centrifugal pump 20 can guide the cooling liquid 400 to sequentially pass through the inlet pipe 30, the input tank 121, at least one input channel 111, the first bottom tank 122, at least one first intermediate channel 112, the first top tank 123, and then to enter into the centrifugal tank 124. As shown in FIG. 11, FIG. 14 and FIG. 15, the cooling liquid 400 in the centrifugal tank 124 flows radially toward the second top tank 125 after passing through the centrifugal pump 20. The rotation of the centrifugal pump 20 can further push the cooling liquid 400 to return to the external flow channel 501 through the second top tank 125, at least one second intermediate channel 113, second bottom tank 126, at least one output channel 114, the output tank 127 and the outlet pipe 40.

As such, through the input tank 121, at least one input channel 111, the first bottom tank 122, at least one first intermediate channel 112, the first top tank 123, the centrifugal tank 124, the second top tank 125, at least one second intermediate channel 113, the second bottom tank 126, at least one output channel 114, and the output tank 127, a considerably long flow path of the cooling liquid 400 is provided by the liquid-cooled heat dissipation device 1 of the present invention, thereby increasing the heat dissipation area of the cooling liquid 400 and improving the heat dissipation effect of the cooling liquid 400.

Furthermore, the centrifugal tank 20 is located at a center position of all the liquid flow channels 11 and all the storage tanks 12, so the centrifugal pump 20 may facilitate the cooling liquid 400 to flow at a stable flow rate inside the main body 10.

As shown in FIG. 12 to FIG. 15, the input tank 121, the first top tank 123, the centrifugal tank 124, the second top tank 125 and the output tank 127 are located on the first side 101 of the main body 10. The first bottom tank 122 and the second bottom tank 126 are located on the second side 102 of the main body 10.

In a preferred embodiment, as shown in FIG. 5 to FIG. 8, the centrifugal tank 124 is located at the center of the main body 10, and the centrifugal pump 20 is disposed in the centrifugal tank 124. In other words, the centrifugal pump 20 is substantially located at the center of the main body 10, so the centrifugal pump 20 can facilitate the cooling liquid 400 to flow inside the main body 10 at a stable flow rate.

As shown in FIG. 11, at least two of the liquid storage tanks 12 adjacent to and in communication with the centrifugal tank 124 (i.e., the first top tank 123 and the second top tank 125 of the preferred embodiment) have fan-shaped structure. Due to the structural characteristics of the fan-shaped tanks, at least two of the liquid storage tanks 12 adjacent to and in communication with the centrifugal tank 124 (i.e., the first top tank 123 and the second top tank 125 of the preferred embodiment) allows the obstruction to the flow of the cooling liquid 400 to be reduced. As such, the cooling liquid 400 flowing in and out of the centrifugal tank 124 is more stable and more evenly distributed, thereby reducing the occurrence of turbulent flow and reducing the fluid motion loss.

As shown in FIG. 11, at least two of the liquid storage tanks 12 (i.e., the input tank 121 and the output tank 127 of the preferred embodiment), which are located on the same side of the main body 10 as the centrifugal tank 124 and are not in communication with each other, have an arc-shaped structure. Since the structural characteristics of the arc-shaped tanks and the structural characteristics of the fan-shaped tanks are the same, the arc-shaped tanks can also achieve the effect of the fan-shaped tanks. Due to the structural characteristics of the fan-shaped tanks and the arc-shaped tanks, the liquid storage tanks 12 on the same side of the main body 10 as the centrifugal tank 124 (i.e., the input tank 121, the first top tank 123, the second top tank 125 and the output tank 127 of the preferred embodiment) allows the obstruction of the flow of the cooling liquid 400 to be reduced. As such, the cooling liquid 400 in the liquid storage tanks 12 that are located on the same side as the centrifugal tank 124 (i.e., the input tank 121, the first in the top tank 123, the second top tank 125, and the output tank 127) has a stable flow and a relatively evenly distribution, thereby reducing the occurrence of turbulent flow and reducing the fluid motion loss.

In other embodiments, the liquid storage tanks 12 on the same side of the body 10 as the centrifugal tank 124 (i.e., the input tank 121, the first top tank 123, the second top tank 125 and the output tank 127 of the preferred embodiment) are all fan-shaped tanks or arc-shaped tanks, which are also capable of achieving the above effect.

As shown in FIG. 11, at least two of the liquid storage tanks 12 adjacent to and in communication with the centrifugal tank 124 (i.e., the first top tank 123 and the second top tank 125 of the preferred embodiment) have equal volumes. In other words, at least two of the liquid storage tanks 12 adjacent to and in communication with the centrifugal tank 124 (i.e., the first top tank 123 and the second top tank 125 of the preferred embodiment) can contain an equal amount of cooling liquid 400. Therefore, the flow rate of the cooling liquid 400 that enters and exits the centrifugal tank 124 per unit time is equal, so that the flow of the cooling liquid 400 is more stable and the distribution is more evenly. Consequently, the occurrence of turbulent flow and the fluid motion loss can be reduced.

As shown in FIG. 11, an outer tank 1231, 1251 of each liquid storage tank 12 adjacent to and in communication with the centrifugal tank 124 (i.e., the first top tank 123 and the second top tank 125 of the preferred embodiment) and the other storage tanks 12 on the same side of the main body 10 as the centrifugal tank 124 (i.e., the input tank 121 and the output tank 127 of the preferred embodiment) have the same volume. In other words, the outer tanks 1231, 1251 of the liquid storage tanks 12 adjacent to and in spatial communication with the centrifugal tank 124 (i.e., the first top tank 123 and the second top tank 125 of the preferred embodiment) and the other storage tanks 12 located on the same side of the main body 10 as the centrifugal tank 124 (i.e., the input tank 121 and the output tank 127 of the preferred embodiment) can contain the same amount of cooling liquid 400. In turn, the flux of the cooling liquid 4000 in the liquid storage tank 12 (i.e., the input tank 121, the outer tank 1231 of the first top tank 123, the outer tank 1251 of the second top tank 125 and the output tank 127 of the preferred embodiment) entering and exiting the centrifugal tank 124 on the same side of the main body 10 in a unit time is equal to each other. As a result, the flow of the cooling liquid 400 is more stable and the distribution is more evenly, thereby reducing the occurrence of turbulent flow and reducing the fluid motion loss.

As shown in FIGS. 5-8, FIG. 13 and FIG. 14, the centrifugal tank 124 is formed with an outer tank 1241, a perforation 1242 and an inner tank 1243 along an axis of the main body 10. The perforation 1242 is in communication with the outer tank 1241 and the inner tank 1243 of the centrifugal tank 124. An inlet 1244 is radially and outwardly formed on the outer tank 1241 of the centrifugal tank 124. An outlet 1245 is radially and outwardly formed on the inner tank 1243 of the centrifugal tank 124. At least two of the liquid storage tanks 12, which are adjacent to and in communication with the centrifugal tank 124 (i.e., the first top tank 123 and the second top tank 125), are in communication with the inlet 1244 and the outlet 1245, respectively. The centrifugal pump 20 is disposed in the inner tank 1243 of the centrifugal tank 124. As shown in FIG. 11 to FIG. 15, the flow direction of the cooling liquid 400 is as follows: first, the cooling liquid 400 in the first top tank 123 passes radially through the inlet 1244 and enters the outer tank 1241 of the centrifugal tank 124; then, the cooling liquid 400 in the outer tank 1241 of the centrifugal tank 124 passes through the perforation 1242 axially and enters the inner tank 1243 of the centrifugal tank 124; and finally, the cooling liquid 400 in the inner tank 1243 of the centrifugal tank 124 can smoothly and evenly follow the resulting streamline direction by the centrifugal pump 20 to passes radially through the outlet 1245 into the second top tank 125. As such, the layered design of the centrifugal tank 124 can ensure that the cooling liquid 400 enters and exits the centrifugal tank 124 in one direction, so as to avoid the cooling liquid 400 in the centrifugal tank 124 from flowing back to the first top tank 123, and prevents the cooling liquid 400 in the second top tank 125 from flowing back to the centrifugal tank 124.

As shown in FIG. 4 and FIG. 5, the main body 10 further comprises an outer cover 13. The outer cover 13 seals the open sides of at least two of the liquid storage tanks 12 that are adjacent to and in communication with the centrifugal tank 124 (i.e., the first top tank 123 and the second top tank 125). More specifically, one side of each of the at least two of the liquid storage tanks 12 adjacent to and in communication with the centrifugal tank 124 (i.e., the first top tank 123 and the second top tank 125) is an open side, which facilitates the manufacturing process of the at least two of the liquid storage tanks 12 (i.e., the first top tank 123 and the second top tank 125) that are fan-shaped. The outer cover 13 can prevent the cooling liquid 400 from passing through and leaking out from the open sides of the at least two of the liquid storage tanks 12 (i.e., the first top tank 123 and the second top tank 125).

More specifically, as shown in FIGS. 5-8 and FIGS. 11-13, the first top tank 123 comprises the outer tank 1231 and an inner tank 1232. The outer tank 1231 and the inner tank 1232 of the first top tank 123 are in communication with each other. At least one first intermediate channel 112 is in communication with the first bottom tank 122 and the outer tank 1231 of the first top tank 123. The inner tank 1232 of the first top tank 123 is in communication with the inner tank 1231 of the centrifugal tank 124. As shown in FIGS. 5-8, FIG. 11, FIG. 14-15, the second top tank 125 comprises the outer tank 1251 and an inner tank 1252. The outer tank 1251 of the second top tank 125 and the inner tank 1252 of the second top tank 125 are in communication with each other, At least one second intermediate channel 113 is in communication with the second bottom tank 126 and the outer tank 1251 of the second top tank 125, and the inner tank 1252 of the second top tank 125 is in communication with the inner tank 1243 of the centrifugal tank 124. As shown in FIG. 5, one side of the inner tank 1232 of the first top tank 123 and the inner tank 1252 of the second top tank 125 is an open side, which facilitate the manufacturing process of the fan-shaped first top tank 123 and second top tank 125. The outer cover 13 seals the open sides of the inner tank 1232 of the first top tank 123 and the inner tank 1252 of the second top tank 125 to prevent the coolant 400 from passing through and leaking out from the open sides of the inner tank 1232 of the first top tank 123 and the inner tank 1252 of the second top tank 125.

Preferably, as shown in FIG. 5 to FIG. 8, one side of the outer tank 1241 of the centrifugal tank 124 is also an open side, which facilitates the manufacturing of the outer tank 1241 of the centrifugal tank 124. The outer cover 13 seals the open side of the outer tank 1241 of the centrifugal tank 124 to prevent the cooling liquid 400 from passing through and leaking out from the open side of the outer tank 1241 of the centrifugal tank 124.

As shown in FIG. 5 to FIG. 8, the main body 10 further comprises a blocking portion 181. The blocking portion 181 seals the inner side of the input tank 121 and the output tank 127. Two concave tanks 1281, 1282 are formed between an outer wall 1246 of the centrifugal tank 124 and the blocking portion 181, and one side of the concave tanks 1281, 1282 is an open side. The blocking portion 181 seals the inner side of the input tank 121 and the output tank 127. As such, the cooling liquid 400 is prevented from entering the concave tanks 1281, 1282 through the input tank 121 and the output tank 127, and further prevented from leaking out from the open side of the concave tanks 1281, 1282.

As shown in FIG. 5 to FIG. 8, the input tank 121 and the first top tank 123 are separated by a first partition 182, and the first top tank 123 and the second top tank 125 are separated by a second partition 183, the second top tank 125 and the output tank 127 are separated by a third partition 184, and the output tank 127 and the input tank 121 are separated by a fourth partition 185. The first partition 182, the second partition 183, the third partition 184 and the fourth partition 185 are respectively connected to the four connection positions of the outer wall 1246 of the centrifugal tank 124. None of the length direction of the first partition 182, the second partition 183, the third partition 184 and the fourth partition 185 passes through the axis of the centrifugal tank 124. The first partition 182 is perpendicular to the second partition 183. The second partition 183 is perpendicular to the third partition 184. The first partition 182 is parallel to the third partition 184. The fourth partition 185 is perpendicular to the first partition 182 and the third partition 184, and the fourth partition 185 is parallel to the second partition 183. Through the arrangement of the first partition 182, the second partition 183 and the third partition 184, the first top tank 123 and the second top tank 125 are formed as fan-shaped tanks. Through the arrangement of the first partition 182, the third partition 184, the fourth partition 185 and the blocking portion 181, the input tank 121 and the output tank 127 are formed as arc-shaped tanks.

As shown in FIG. 5 to FIG. 9, among the liquid storage tanks 12 that are located on different sides of the main body 10 and are in communication with each other, the volume of the liquid storage tank 12 having a larger volume and located on one side of the main body 10 is equal to the total volume of other liquid storage tanks 12 on the other side of the main body 10 that are in spatial communication therewith. In a unit time, regardless of whether the flow rate of the cooling liquid 400 into and out of the liquid storage tank 12, which has a larger volume and located on one side of the main body 10, are equal, the flux of the cooling liquid 400 into and out of the liquid storage tank 12 is relatively stable and the distribution is relatively even. As such, the occurrence of turbulent flow and the fluid motion loss may be reduced, and may be free from the influence by the flux of the cooling liquid 400 into and out of the liquid storage tank 12 having a larger volume and located on the side of the main body 10.

Preferably, the volumes of the other liquid storage tanks 12 on the other side of the main body 10 are equal to each other. In a unit time, the flux of the cooling liquid 400 into and out of the liquid storage tank 12, which has a larger volume and located on one side of the main body 10, are equal, thereby accelerating the overall flow rate of the cooling liquid 400 through the main body 10, improving the cooling effect of the cooling liquid 400, and increasing the efficiency of repeated heat dissipation.

In a preferred embodiment, the liquid storage tanks 12, which are located on different sides of the main body 10 and are in communication with each other, comprise the following two combinations: (1) the input tank 121, the first bottom tank 122 and the outer tank 1231 of the first top tank 123; (2) the outer tank 1251 of the second top tank 125, the second bottom tank 126 and the output tank 127. As shown in FIG. 12 and FIG. 13, in the combination (1), the liquid storage tank 12 having a larger volume and located on the second side 102 of the main body 10 is the first bottom tank 122, the other storage tanks 12 located on the first side 101 of the main body 10 that communicates with the first bottom tank 122 are the input tank 121 and the outer tank 1231 of the first top tank 123. The volume of the first bottom tank 122 is equal to the total volume of the input tank 121 and the outer tank 1231 of the first top tank 123, the volume of the input tank 121 and the outer tank 1231 of the first top tank 123 are equal. As shown in FIG. 14 and FIG. 15, in the combination (2), the liquid storage tank 12 having a larger volume and located on the second side 102 of the main body 10 is the second bottom tank 126, and the other storage tanks 12 located on the first side 101 of the main body 10 that are in communication with the second bottom tank 126 are the outer tank 1251 of the second top tank 125 and the output tank 127. The volume of the second bottom tank 126 is equal to the total volume of the outer tank 1251 of the second top tank and the output tank 127, and the outer tank 1251 of the second top tank 125 and the output tank 127 have the same volume. As such, the flow of the cooling liquid 400 into and out of the first bottom tank 122 and the second bottom tank 126 is more stable and more evenly distributed, thereby reducing the occurrence of turbulent flow and reducing the fluid motion loss. Furthermore, the flux of the cooling liquid 400 entering and leaving the first bottom tank 122 and the second bottom tank 126 are equal, which accelerate the overall flow rate of the cooling liquid 400 through the main body 10, improves the cooling effect of the cooling liquid 400, and increases the efficiency of repeated heat dissipation.

Figure 10:
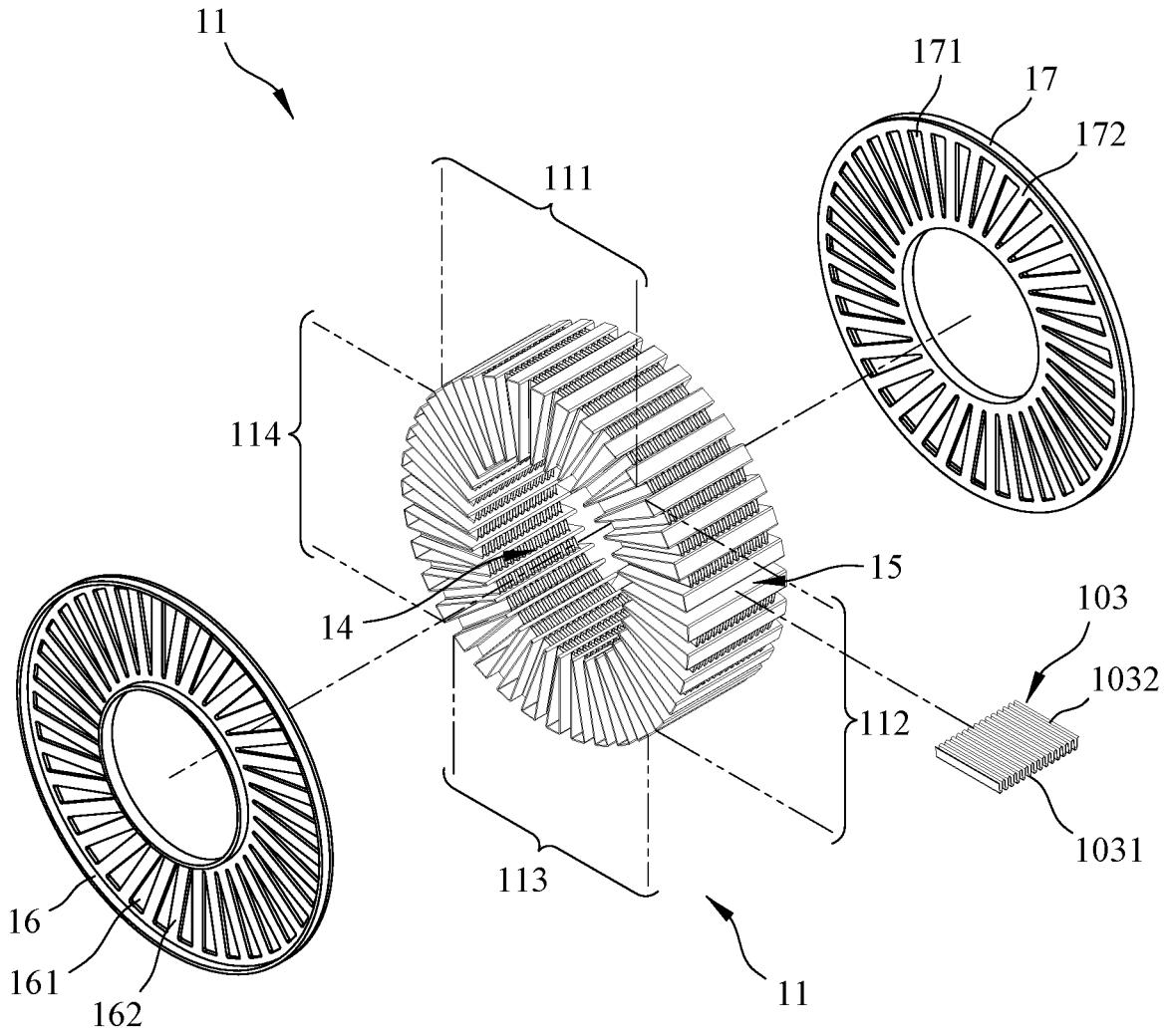
FIG. 10 is an exploded view of the liquid flow channel, the first cover, the second cover and the heat dissipation fins of the present invention.

As shown in FIG. 10, FIG. 11 and FIG. 15, the number of liquid flow channels 11 in spatial communication with each of the liquid storage tanks 12 on the same side of the main body 10 are the same, and the cross-sectional areas of the liquid flow channels 11 are equal. In a unit time, the cooling liquid 400 flowing into and out of the liquid storage tanks 12 on the same side of the main body 10 is more stable and more evenly distributed, thereby reducing the occurrence of turbulent flow and reducing the fluid motion loss. In a unit time, the flux of the cooling liquid 400 entering and exiting the liquid storage tanks 12 on the same side of the main body 10 are equal, which accelerates the overall flow rate of the cooling liquid 400 through the main body 10, improves the cooling effect of the cooling liquid 400, and increases the efficiency of repeated heat dissipation.

More specifically, the number of channels for at least one input channel 111, at least one first intermediate channel 112, at least one second intermediate channel 113 and at least one output channel 114 are all the same. Further, at least one input channel 111, at least one first intermediate channel 112, at least one second intermediate channel 113 and at least one output channel 114 have equal cross-sectional areas. The cooling fluid 400 flowing into and out of the input tank 121, the outer tank 1231 of the first top tank 123, the outer tank 1251 of the second top tank 125 and the output tank 127 located on the first side 101 of the main body 10 is relatively stable and more evenly distributed. In a unit time, the flow of the cooling liquid 400 into and out of the first bottom tank 122 and the second bottom tank 126 on the second side 102 of the main body 10 is more stable and more evenly distributed, thereby reducing the occurrence of turbulent flow and reducing the fluid motion loss. In a unit time, the flux of the cooling liquid 400 that enters and exits the input tank 121, the outer tank 1231 of the first top tank 123, the outer tank 1251 of the second top tank 125 and the output tank 127 on the first side 101 of the main body 10 are equal, and the flux of the cooling liquid 400 that enters and exits the first bottom tank 122 and the second bottom tank 126 on the second side 102 of the main body 10 are equal. As such, the overall flow rate of the cooling liquid 400 through the main body 10 is accelerated, the cooling effect of the cooling liquid 400 is improved, and the efficiency of repeated heat dissipation is also increased.

In a preferred embodiment, the liquid flow channel 11 comprises input channels 111, first intermediate channels 112, second intermediate channels 113 and output channels 114. The total cross-sectional area of the input channels 111, the total cross-sectional area of the first intermediate channels 112, the total cross-sectional area of the second intermediate channels 113 and the total cross-sectional area of the output channels 114 are larger than the cross-sectional area of the pipeline 2044 connected to the tank 201 in the conventional heat dissipation system. Hence, under the same volume flow rate, the flow rate of the cooling liquid 400 in the input channels 111 into the first bottom tank 122 decreases, and the flow rate of the cooling liquid 400 in the first intermediate channel 112 entering the outer tank 1231 of the first top tank 123 decreases. Further, the flow rate of the cooling liquid 400 in the second intermediate channels 113 entering the second bottom tank 126 decreases, and the flow rate in the output channel 114 of the cooling liquid 400 entering the output tank 127 decreases. As a result, the phenomenon of internal turbulence within the cooling liquid 400 is reduced, the amount of bubbles generated is decreased, and the heat absorbing effect of the cooling liquid 400 is also enhanced.

In addition, the greater the number of the liquid flow channels 11, the greater the total heat dissipation area provided by the liquid flow channels 11. As the total heat dissipation area increases, the cooling effect of the cooling liquid 400 also becomes more significant.

In addition, the material of the liquid flow channels 11 has a high thermal conductivity. Therefore, the liquid flow channels 11 can absorb the thermal energy of the cooling liquid 400 in an efficient manner, which further enhances the cooling effect of the cooling liquid 400.

As shown in FIG. 3 and FIG. 4, the main body 10 has a disc shape. Specifically, as shown in FIG. 5 to FIG. 10, the liquid flow channels 11 are disposed in circumferential manner and are spaced apart from each other. The centrifugal tank 124 is located at the center of the first side 101 of the main body 10. The input tank 121, the first top tank 123, the second top tank 125, the output tank 127 and other liquid storage tanks 12 located on the same side as the centrifugal tank 124 on the main body 10 are disposed around the centrifugal tank 124 along the circumferential direction. The liquid storage tanks 12, such as the first bottom tank 122 and the second bottom tank 126 that are located on the second side 102 of the main body 10, are circumferentially arranged along the circumferential direction. With the above configuration, the main body 10 has a disc shape, the overall structure is compact, the volume is small, the weight is light, and the structural strength is great.

As shown in FIG. 3 to FIG. 5, the main body 10 further comprises a shaft hole 14 and a plurality of airflow channels 15. The liquid flow channels 11 are arranged around the shaft hole 14 along the circumferential direction. The airflow channels 15 are respectively located between the liquid flow channels 11 and are in spatial communication with the shaft hole 14 and outside space. As shown in FIG. 3 and FIG. 5, the liquid-cooled heat dissipation system 1 of the present invention further comprises a centrifugal fan 50 and a motor 60. The centrifugal fan 50 is disposed in the shaft hole 14. The motor 60 is disposed at the centrifugal fan 50 and is configured to drive the centrifugal pump 20 and the centrifugal fan 50 to rotate simultaneously through a driving shaft 61.

As shown in FIG. 11 to FIG. 15, when the driving shaft 61 rotates, the rotation of the centrifugal pump 20 guides the cooling liquid 400 to pass through the inlet pipe 30, the main body 10 and the outlet pipe 40 in sequence.

As shown in FIG. 13 and FIG. 14, when the drive shaft 61 rotates, the rotation of the centrifugal fan 50 guides the air 401 to flow axially from the shaft hole 14 into the main body 10. Centrifugal airflows 402 are formed after the air passes through the centrifugal fan 50, and then, centrifugal airflows 402 leave the main body 10 radially through the airflow channels 15. During the flow of the centrifugal airflow 402 through the airflow channels 15, the thermal energy of the high-temperature cooling liquid 400 flowing in the liquid flow channels 11 can be blown to the outside space.

With the extended flow path provided by the liquid flow channels 11 and the liquid storage tanks 12 for the high-temperature cooling fluid 400, a considerable thermal dissipation effect may be achieved by the contact between the centrifugal air flow 402 and the liquid flow channels 11. By further configuring the centrifugal airflow 402 to flow radially through the airflow channels 15, the temperature of the cooling liquid 400 may be quickly reduced, thereby enhancing the cooling effect of the cooling liquid 400 and further boosting the heat dissipation efficiency of the device of the present invention.

Furthermore, through the ingenious design of the liquid flow channels 11, the airflow channels 15 and the liquid storage tanks 12 of the main body 10, with the motor 60 synchronously driving the centrifugal pump 20 and the centrifugal fan 50, the liquid-cooled heat dissipation device 1 of the present invention can facilitate the flow of the cooling liquid 400 with the centrifugal pump 20 while and providing the centrifugal airflow 402 with the centrifugal fan 50 to dissipate the cooling liquid 400. Such a design is equivalent to an integration of the traditional tank, pump and radiator, but without any pipelines. As a result, the overall structure of the liquid-cooled heat dissipation device 1 of the present invention is compact, small in size, light in weight and good in structural strength. In addition, it can be easily assembled on or near any object 502.

Figure 16:
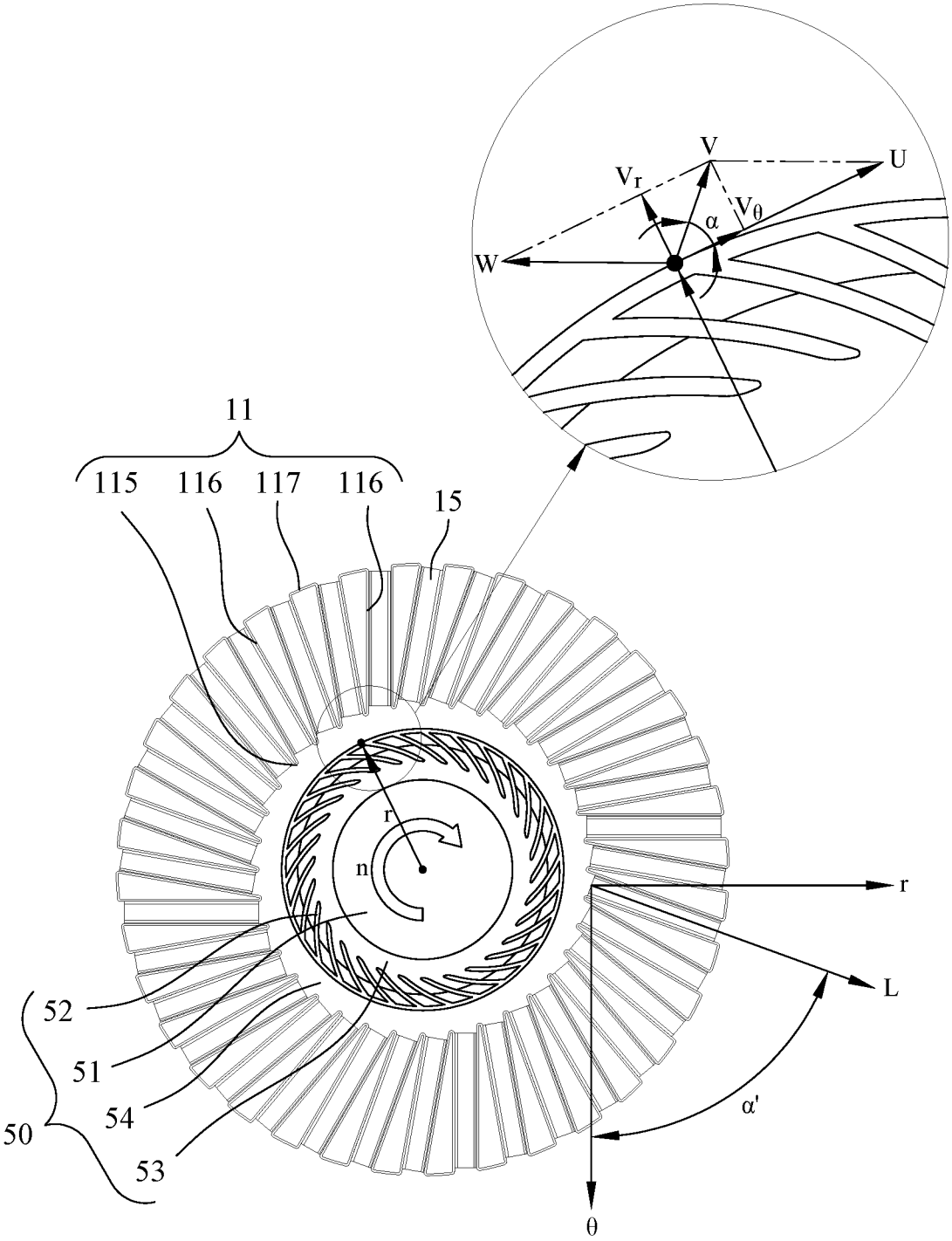
FIG. 16 is a cross-sectional view along line C-C of FIG. 4.

In a preferred embodiment, as shown in FIG. 16, the outflow direction of the centrifugal airflow 402 from the centrifugal fan 50 is aligned with the longitudinal direction of the airflow channels 15. In this way, the centrifugal airflow 402 can pass through the airflow channels 15 in a straight line, so that the flow resistance of the airflow can be reduced. As such, a higher airflow velocity may be obtained under the same fan power, thereby improving the heat dissipation efficiency of the system.

More specifically, the velocity vector of the centrifugal airflow 402 in the circumferential tangent direction of the centrifugal fan 50 is U, the velocity vector of the centrifugal airflow 402 under the Global coordinate system is V, and the angle between V and U is $\alpha$. The longitudinal direction is L, the circumferential tangent direction of the liquid-cooled heat dissipation device 1 is $\theta$, and $\alpha'$ is the angle between L and $\theta$. According to the definitions of the above basic conditions, the design goal of the present invention is $\alpha=\alpha'$. With the establishment of the above relations, the condition of "the direction of the outflow of the centrifugal airflow 402 from the centrifugal fan 50 aligning with the longitudinal direction of the airflow channels 15" can be achieved.

Preferably, the velocity vector of the centrifugal airflow 402 relative to the tip of the fan blade 52 of the centrifugal fan 50 is W, the sum vector of the velocity vectors of W and U is V, the component of V in the circumferential direction is Vr, and the component in the tangential direction T is Ve, the radial direction of the liquid-cooled heat dissipation device 1 is r, and n is the rotation direction of the centrifugal fan 50. Through the establishment of the above relationship, the condition that the velocity vector of the centrifugal airflow 402 under the Global coordinate system is V can be clearly defined.

As shown in FIG. 10 and FIG. 16, the liquid flow channels 11 are spaced apart from each other, and an airflow channel 15 is formed between each two adjacent two liquid flow channels 11. In other words, an air flow channel 15 is provided on both sides of each liquid flow channel 11. Thereby, the heat of the cooling liquid 400 passing through each liquid flow channel 11 can be blown out to the outside space by the centrifugal airflow 402 of the two airflow channels 15 on both sides of each liquid flow channel 11. Consequently, an uniform and stable heat dissipation effect can be provided.

In a preferred embodiment, the cross-sectional shape of each liquid flow channel 11 is fan-shaped, and the cross-sectional shape of each air flow channel 15 is rectangular. Thereby, the liquid flow channels 11 and the airflow channels 15 can be arranged in an interweaved manner along the circumferential direction in a surrounding circle, so that the main body 10 has a disc shape. From a manufacturing point of view, the shape of the liquid flow channels 11 has the advantages of easy manufacturing, low cost, and easy assembly.

Preferably, each liquid flow channel 11 has a tip 115, two planar side walls 116 and a curved outer wall 117. The tip 115 of each liquid flow channel 11 is toward the center of the main body 10, the curved outer wall 117 of each liquid flow channel 11 is located on the opposite side of the tip 115 of each liquid flow channel 11, and the two planar side walls 116 of the adjacent two liquid flow channels 11 are parallel to each other. In other words, each liquid flow channel 11 itself is a fan-shaped hollow sector. The liquid flow channels 11 are cleverly arranged in the above manner to form a circle. The adjacent two liquid flow channels 11 are separated by a predetermined distance to form rectangular airflow channel 15.

Preferably, the cross-sectional areas of each of the liquid flow channels 11 are equal to each other, and the cross-sectional areas of each of the airflow channels 15 are equal to each other. In other words, each of the liquid flow channels 11 have the same size, and each of the airflow channels 15 have the same size. With the above arrangement, all the liquid flow channels 11 can be manufactured with a single mold. As such, the manufacturing cost is low, and the assembly is effortless. Furthermore, in a unit time, the flux of the cooling liquid 400 through the liquid flow channels 11 is equal, and the flux of the centrifugal airflow 402 through the airflow channels 15 is equal, so that the same heat dissipation effect can be obtained for the cooling liquid 400 passing through the liquid flow channels 11, and the high-temperature centrifugal airflow 402 can evenly flow to the outside space.

As shown in FIG. 3 and FIG. 5, the shaft hole 14 penetrates through the second side 102 of the main body 10. That is, as shown in FIG. 4, the first side 101 of the main body 10 is not penetrated by the shaft hole 14. As shown in FIG. 13 and FIG. 14, when the driving shaft 61 rotates, the rotation of the centrifugal fan 50 will guide the air 401 to flow axially from the second side 102 of the main body 10 into the main body 10 through the shaft hole 14. After the air 401 is passed through the centrifugal fan 50, the centrifugal airflow 402 is formed and is configured to radially exit the main body 10 via the airflow channels 15 instead of leaving the main body 10 as an axial flow from the first side 101 of the main body 10.

As shown in FIG. 5 and FIG. 10, the main body 10 further comprises a first cover 16 and a second cover 17. The first cover 16 is disposed between a first side of the liquid flow channels 11 in the axial direction and the liquid storage tanks 12, such as the input tank 121, the first top tank 123, the second top tank 125 and the output tank 127, located on the first side 101 of the main body 10. The first cover 16 comprises first hollow portions 161 and first sealed portions 162. The first hollow portions 161 are connected to and in communication with the liquid flow channels 11 and the liquid storage tanks 12, such as the input tank 121, the first top tank 123, the second top tank 125 and the output tank 127 located on the first side 101 of the main body 10. The first sealed portions 162 respectively seal a first side of the airflow channel 15 in the axial direction. The second cover 17 is disposed between a second side of the liquid flow channels 11 in the axial direction and the liquid storage tanks 12, such as the first bottom tank 122 and the second bottom tank 126, located on the second side 102 of the main body 10. The second cover 17 comprises second hollow portions 171 and second sealed portions 172. The second hollow portions 171 are respectively connected to and in communication with the liquid flow channels 11 and the liquid storage tanks 12, such as the first bottom tank 122 and the second bottom tank 126, located on the second side 102 of the main body 10. The second sealed portions 172 respectively seal a second side of the airflow channel 15 in the axial direction. As such, the first cover 16 and the second cover 17 can completely block the centrifugal airflow 402 from flowing upward or downward from the first side or the second side of the airflow channels 15 in the axial direction, so as to ensure that the centrifugal airflow 402 passes through the airflow channel 15 radially when leaving the body main 10. Furthermore, the first cover 16 and the second cover 17 can ensure that the cooling liquid 400 flows only between the liquid flow channels 11 and the liquid storage tanks 12, so as to prevent the cooling liquid 400 from flowing into the airflow channels 15.

In a preferred embodiment, the shaft hole 14 penetrates the first cover 16 and the second cover 17. Both the first cover 16 and the second cover 17 are circular and are arranged to match the liquid flow channel 11, so that the main body 10 is in the shape of a disc. As shown in FIG. 13 and FIG. 14, the drive shaft 61 can be directly connected to the centrifugal pump 20 without being blocked by the first cover 16. As shown in FIG. 13 and FIG. 14, when the driving shaft 61 rotates, the rotation of the centrifugal fan 50 will guide the air 401 to flow axially through the shaft hole 14 from the second side 102 of the main body 10 into the main body 10, without being subjected to blocking by the second cover 17.

Preferably, the first hollow portions 161 are arranged along the circumferential direction and are spaced apart from each other, and a first sealed portion 162 is formed between each two adjacent first hollow portions 161. The second hollow portions 171 are arranged along the circumferential direction and are spaced apart from each other, and a second sealed portion 172 is formed between each two adjacent two second hollow portions 171. In other words, the arrangement of the first hollow portions 161 and the second hollow portions 171 corresponds to the arrangement of the liquid flow channels 11, and the arrangement of the first sealed portions 162 and the second sealed portions 172 corresponds to the arrangement of the airflow channels 15.

Preferably, the cross-sectional shapes of the first hollow portions 161 respectively correspond to the cross-sectional shapes of the liquid flow channels 11, and the cross-sectional shapes of the first sealed portions 162 respectively correspond to the cross-sectional shapes of the airflow channels 15. The cross-sectional shapes of the second hollow portions 171 respectively correspond to the cross-sectional shapes of the liquid flow channels 11, and the cross-sectional shapes of the second sealed portions 172 respectively correspond to the cross-sectional shapes of the airflow channels 15.

As shown in FIG. 3 to FIG. 9, the main body 10 further comprises a first shell 18 and a second shell 19. The first shell 18 is located on the first side 101 of the main body 10 and is disposed on the first cover 16. The liquid storage tanks 12, such as the input tank 121, the first top tank 123, the centrifugal tank 124, the second top tank 125 and the output tank 127, located on the first side 101 of the main body 10 are disposed in the first shell 18. The second shell 19 is located on the second side 102 of the main body 10 and is disposed on the second cover 17. The liquid storage tanks 12, such as the first bottom tank 122 and the second bottom tank 126, located on the second side 102 of the main body 10 are disposed in the second shell 19.

In a preferred embodiment, the first shell 18 is configured as disc-shaped to seal the shaft hole 14. The shaft hole 14 penetrates the second shell 19. The second shell 19 thus has an annular shape to match the arrangement of the liquid flow channels 11 and the shapes of the first cover 16 and the second cover 17. In turn, the main body 10 is disk-shaped. As shown in FIG. 13 and FIG. 14, when the driving shaft 61 rotates, the rotation of the centrifugal fan 50 will guide the air 401 to flow axially from the second side 102 of the main body 10 into the main body 10 through the shaft hole 14 without being affected or blocked by the second shell 19. After passing through the centrifugal fan 50, the air 401 forms centrifugal airflows 402 and leaves the main body 10 radially through the airflow channels 15. In such a way, the air 401 does not leave the main body 10 axially through the first shell 18.

As shown in FIGS. 3-5 and FIG. 10, the main body 10 further comprises a plurality of heat dissipation fins 103, and the heat dissipation fins 103 are respectively disposed in the airflow channels 15. The heat dissipation fins 103 may further absorb the thermal energy from the planar side walls 116 of the liquid flow channels 11. As shown in FIG. 13 and FIG. 14, the heat dissipation fins 103 provide a larger heat dissipation area. When the centrifugal airflow 402 flows radially through the airflow channels 15, the centrifugal airflow 402 can simultaneously blow the thermal energy of the planar side walls 116 of the fluid flow channels 11 and on the surfaces of the heat dissipation fins 103 to the outside space so as to indirectly cool down the cooling liquid 400 passing through the liquid flow channels 11. As a result, the heat dissipation effect of the cooling liquid can be further enhanced.

Preferably, each of the heat dissipation fins 103 contacts the planar side walls 116 of the adjacent two liquid flow channels 11 at multiple points. Specifically, each heat dissipation fin 103 is wavy in shape and has multiple peaks 1031 and multiple bases 1032. The peaks 1031 are in contact with the planar side wall 116 of one of the adjacent two liquid flow channels 11, and the bases 1032 are in contact with the planar side wall 116 of the other one of the adjacent two liquid flow channels 11. In this way, the thermal energy on the planar side walls 116 of the adjacent two liquid flow channels 11 can be uniformly diffused through the peaks 1031 and the bases 1032 to the entire heat dissipation fin 103, thereby improving the heat dissipation effect of the cooling liquid.

In a preferred embodiment, as shown in FIG. 5, FIG. 13 and FIG. 14, the drive shaft 61 has a first end 611 and a second end 612. The first end 611 of the drive shaft 61 is connected to and configured to drive the centrifugal pump 20 to rotate, the second end 612 of the drive shaft 61 is connected to and configured to drive the centrifugal fan 50 to rotate. The centrifugal pump 20 comprises a pump body 21 and pump blades 22. The first end 611 of the drive shaft 61 is connected to the axle of the pump body 21. The pump blades 22 are disposed on the pump body 21 and are spaced around the axle of the pump body 21. The centrifugal fan 50 comprises a fan body 51 and fan blades 52. The motor 60 is located on the fan body 51. The second end 612 of the drive shaft 61 is connected to the axle of the fan body 51. The fan blades 52 are spaced around the fan body 51 and are configured to form an air collecting trough 53 in-between with the fan body 51.

As shown in FIG. 11 to FIG. 15, when the drive shaft 61 rotates, the rotation of the pump body 21 drives the pump blades 22 to rotate synchronously, and the pump blades 22 will guide the cooling liquid 400 to sequentially pass through the inlet pipe 30, the main body 10 and the outlet pipe 40. The cooling liquid 400 flows between the liquid storage tanks 12 through the liquid flow channels 11 and forms radial jet flows after passing through the pump blades 22.

As shown in FIG. 13 and FIG. 14, when the drive shaft 61 rotates, the rotation of the fan body 51 drives the fan blades 52 to rotate synchronously, and the fan blades 52 guide air 401 to flow axially from the shaft hole 14 into the air collecting trough 53. After the air 401 passes through the gap between the fan blades 52, the air 401 forms centrifugal airflows 402 and radially leaves the main body 10 via the airflow channels 15.

Preferably, as shown in FIG. 13, FIG. 14 and FIG. 16, an air outlet chamber 54 is formed between the fan blades 52 and the liquid flow channels 11. The following two benefits can be obtained by the formation of the air outlet chamber 54: first, the fan blades 52 will not collide with the liquid flow channels 11 when rotating; secondly, there will be sufficient room for the centrifugal airflow 402 to align with the airflow channel 15, so that the centrifugal airflow 402 can pass through the corresponding airflow channel 15 via the air outlet chamber 54 in a straight line.

As shown in FIG. 17, the present invention provides a vehicle 500 equipped with a liquid-cooled heat dissipation device 1, an external flow channel 501 and at least one object 502. The external flow channel 501 passes through at least object 502 and is connected to the inlet pipe 30 and the outlet pipe 40. The liquid-cooled heat dissipation device 1 of the present invention can provide a good heat dissipation effect for the object 502 (for example, an engine) of the vehicle 500 of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A liquid-cooled heat dissipation device, comprising: a main body, a centrifugal pump, an inlet pipe, an outlet pipe, a centrifugal fan and a motor;

the main body further comprising: a shaft hole, a plurality of liquid flow channels, a plurality of liquid storage tanks and a plurality of airflow channels, the liquid flow channels being arranged around the shaft hole along a circumferential direction, each of the airflow channels being located between the liquid flow channels and connected to outside space, the liquid storage tanks are respectively located on a first side and a second side of the main body, and two liquid storage tanks on different sides of the main body are in communication with each other through at least one of the liquid flow channels, the liquid storage tanks comprise a centrifugal tank located at a center of the main body, and at least two of the liquid storage tanks adjacent to and directly in communication with the centrifugal tank are fan-shaped tanks;

the centrifugal pump being disposed in the centrifugal tank;

the inlet pipe being in communication with one of the liquid storage tanks;

the outlet pipe being in communication with one of the liquid storage tanks;

the centrifugal fan being disposed in the shaft hole; and the motor being disposed in the centrifugal fan and configured to drive the centrifugal pump and the centrifugal fan to rotate simultaneously through a drive shaft;

wherein when the drive shaft is rotating, the rotation of the centrifugal pump guides a cooling liquid to pass through the inlet pipe, the main body and the outlet pipe in sequence;

wherein the cooling liquid flows through the liquid storage tanks via the liquid flow channels, and radial jet flows are formed after the cooling liquid passes through the centrifugal pump; and wherein when the drive shaft is rotating, the rotation of the centrifugal fan guides air to axially flow through the shaft hole into the main body; once the air passes through the centrifugal fan, the air forms centrifugal airflows and leaves the main body radially through the airflow channels.

2. The liquid-cooled heat dissipation device according to claim 1, wherein outflow direction of each of the centrifugal airflows exiting the centrifugal fan is aligned with a length direction of each of the airflow channels.

3. The liquid-cooled heat dissipation device according to claim 2, wherein assuming a speed vector of the centrifugal airflow in a tangential direction to the circumference of the centrifugal fan is U, a speed vector of the centrifugal airflow under Global coordinate system is V, an angle between V and U is $\alpha$, and the length direction of each of the airflow channels is L, a tangential direction to the circumference of the liquid-cooled heat dissipation device is $\theta$ and an angle between L and $\theta$ is $\alpha'$, then $\alpha=\alpha'$.

4. The liquid-cooled heat dissipation device according to claim 3, wherein assuming the velocity vector of the centrifugal airflow with respect to the tip of a fan blade of the centrifugal fan is W, then a combined velocity vector of W and U is V.

5. The liquid-cooled heat dissipation device according to claim 1, wherein the liquid flow channels are arranged at intervals, and each of the airflow channels is formed between two adjacent liquid flow channels.

6. The liquid-cooled heat dissipation device according to claim 5, wherein a cross-sectional shape of each of the liquid flow channels is fan-shaped, and a cross-sectional shape of each of the airflow channels is rectangular.

7. The liquid-cooled heat dissipation device according to claim 6, wherein each of the liquid flow channels has a tip, two planar side walls and a curved outer wall, the tip of each of the liquid flow channels faces a center of the main body, and the curved outer wall of each of the liquid flow channels is located on a side opposite to the tip, and the two planar side walls of every adjacent two liquid flow channels are parallel to each other.

8. The liquid-cooled heat dissipation device according to claim 5, wherein cross-sectional areas of each of the liquid flow channels are equal and cross-sectional areas of each of the airflow channels are equal.

9. The liquid-cooled heat dissipation device according to claim 1, wherein the main body further comprises a first cover and a second cover; the first cover is disposed on a first side of the liquid flow channels in an axial direction thereof; the first cover comprises a plurality of first hollow portions and a plurality of first sealed portions, the first hollow portions are respectively in communication with the liquid flow channels, and the first sealed portions respectively seal the first side of the airflow channels in an axial direction thereof; the second cover is disposed on a second side of the liquid flow channels in the axial direction thereof, the second cover comprises a plurality of second hollow portions and a plurality of second sealed portions, the second hollow portions are respectively in communication with the liquid flow channels, and the second sealed portions respectively seal the second side of the airflow channel in the axial direction.

10. The liquid-cooled heat dissipation device according to claim 9, wherein the shaft hole penetrates the first cover and the second cover, and both of the first cover and the second cover are circular.

11. The liquid-cooled heat dissipation device according to claim 9, wherein a cross-sectional shape of each of the first hollow portions respectively corresponds to a cross-sectional shape of each of the liquid flow channels, and a cross-sectional shape of each of the first sealed portions respectively corresponds to a cross-sectional shape of each of the airflow channels, a cross-sectional shape of each of the second hollow portions respectively corresponds to a cross-sectional shape of each of the liquid flow channels, and a cross-sectional shape of each of the second sealed portions respectively corresponds to a cross-sectional shapes of each of the airflow channels.

12. The liquid-cooled heat dissipation device according to claim 1, wherein the main body further comprises a first shell and a second shell, the first shell is located on a first side of the main body and seals the shaft hole, the second shell is located on the second side of the main body, the shaft hole penetrates through the second shell.

13. The liquid-cooled heat dissipation device according to claim 1, wherein the shaft hole penetrates through the second side of the main body.

14. The liquid-cooled heat dissipation device according to claim 1, wherein the main body further comprises a plurality of heat dissipation fins, and the heat dissipation fins are respectively disposed in the airflow channels.

15. The liquid-cooled heat dissipation device according to claim 1, wherein the drive shaft has a first end and a second end, the first end of the drive shaft is connected to and configured to drive the centrifugal pump to rotate, and the second end of the drive shaft is connected to and configured to drive the centrifugal fan to rotate.

16. The liquid-cooled heat dissipation device according to claim 1, wherein the centrifugal pump comprises a pump body and a plurality of pump blades, the drive shaft is connected to an axle of the pump body, the pump blades are arranged on the pump body around the axis of the pump body at intervals.

17. The liquid-cooled heat dissipation device according to claim 1, wherein the centrifugal fan comprises a fan body and a plurality of fan blades, the motor is located in the fan body, the drive shaft is connected to an axle of the fan body, the fan blades are disposed around the fan body at intervals and form an air-collecting chamber between the fan body.

18. The liquid-cooled heat dissipation device according to claim 1, wherein an air outlet chamber is formed between the centrifugal fan and the liquid flow channels.

19. A vehicle, comprising the liquid-cooled heat dissipation device according to claim 1, an external flow channel and at least one object to be thermally dissipated, the external flow channel passes through the at least one object to be thermally dissipated and is connected to the inlet pipe and the outlet pipe.

* * * * *